US006301851B1

(12) United States Patent
Matsubara

(10) Patent No.: US 6,301,851 B1
(45) Date of Patent: Oct. 16, 2001

(54) APPARATUS AND METHOD FOR FORMING PRECAST MODULAR UNITS AND METHOD FOR CONSTRUCTING PRECAST MODULAR STRUCTURE

(76) Inventor: Hideo Matsubara, 1-1-1001, Kita 5-jo Nishi 29-chome, Chuo-ku, Sapporo-shi, Hokkaido (JP)

( * ) Notice: Subject to any disclaimer, the term of this patent is extended or adjusted under 35 U.S.C. 154(b) by 0 days.

(21) Appl. No.: 09/362,493

(22) Filed: Jul. 28, 1999

(30) Foreign Application Priority Data

Jul. 29, 1998 (JP) ..... 10-229443

(51) Int. Cl.[7] ..... E04B 2/00

(52) U.S. Cl. ..... 52/430; 52/309.7; 52/426; 52/745.1

(58) Field of Search ..... 52/745.1, 745.13, 52/426, 425, 429, 428, 430, 741.13, 309.7, 309.11

(56) References Cited

U.S. PATENT DOCUMENTS 4,583,336 * 4/1986 Shelangoskie et al. ..... 52/250
5,056,290 * 10/1991 Alexander et al. ..... 52/584
5,092,093 * 3/1992 Lu ..... 52/426
5,678,373 * 10/1997 Franklin et al. ..... 52/439
5,771,648 * 6/1998 Miller et al. ..... 52/309.7
5,836,126 * 11/1998 Harkenrider et al. ..... 52/410
6,070,380 * 6/2000 Meilleur ..... 52/309.7
6,122,880 * 9/2000 Kolb et al. ..... 52/592.6
6,151,856 * 11/2000 Shimonohara ..... 52/426
6,164,035 * 12/2000 Roberts ..... 52/563
6,167,671 * 1/2001 Wilson ..... 52/654.1
6,170,220 * 1/2001 Moore, Jr. ..... 52/741.13

* cited by examiner

*Primary Examiner*—Daniel P. Stodola
*Assistant Examiner*—Curtis A. Cohen
(74) *Attorney, Agent, or Firm*—Adams & Wilks

(57) ABSTRACT

An apparatus for forming precast modular units has at least two modular forms configured to be selectively arranged and interconnected in spaced-apart relation to one another, reinforcement members disposed in each of the modular forms, and connecting members each having a first end integrally connected to one of the reinforcement members and a second end extending from opposite side edges of each of the modular forms. Connectors releasably connect the second end of each of the connecting members of one of the modular forms to a corresponding connecting member of another one of the modular forms to integrally connect the modular forms to one another. A molding plate is configured to be arranged between the side edges of modular forms when the modular forms are connected to one another.

11 Claims, 17 Drawing Sheets

APPARATUS AND METHOD FOR FORMING PRECAST MODULAR UNITS AND METHOD FOR CONSTRUCTING PRECAST MODULAR STRUCTURE

BACKGROUND OF THE INVENTION

1. Field of the Invention

The present invention relates generally to construction systems and, more particularly, to construction systems which employ a plurality of connectable precast modular units which are transported to a building site and erected to construct a building structure, such as a basement, a garage or a floor level suitable as part of a dwelling, or to construct a fire cistern (snow-melting tank), a stilted foundation and the like. The present invention also relates to a method and apparatus for forming precast modular units, and to a precast modular structure and method for constructing the precast modular structure.

2. Background Information

Heretofore, when a basement is being prepared for construction of houses, for example, the ground at a construction site of the basement is excavated, underground water is treated, concrete is poured to form a floor, reinforcing rods are carried to the site and assembled together with temporary frames for forming retaining walls, and concrete is then poured to form the retaining walls. Thereafter, while curing of the concrete is carried out to ensure strengthening of the concrete, a temperature control operation is conducted until the concrete is hardened.

The foregoing conventional method of preparing a basement has the following problems. After the concrete is cured, the temporary frames are disassembled and removed from the site, the concrete surface is repaired, and then the exterior of the concrete structure is entirely waterproofed. Such operations are complicated and take about 3 to 4 weeks to complete. Furthermore, concrete beams, a floor for reinforcement, etc. are required to be constructed at the upper portion of the basement in order to withstand the soil pressure from the exterior. As a result, there arises various problems, for example, poor operational efficiency, prolonged construction and increased cost.

Moreover, masonry and concrete constructions are difficult on building sites in some weather conditions. During cold weather, on-site masonry and concrete construction are generally impossible. On-site masonry and concrete construction can also be delayed by water and snow. These delays increase construction costs.

Methods of constructing basement or garage structures by integrally forming walls, ceilings and floors into a box-like shape and then transporting them to an installation site are known. However, such methods are difficult to carry out because of the difficulty in transporting the basement or garage structure to the installation site due to the large weight of the structure. Accordingly, it has been necessary to reduce the size of such prefabricated structures in order to reduce their overall weight for transportation purposes. As a result, such prefabricated structures enclose relatively small interior spaces and therefore fail to provide sufficient space for storage or living.

SUMMARY OF THE INVENTION

The present invention is directed to precast modular units, a method and apparatus for forming precast modular units, and to a precast modular structure and construction method thereof which overcome the foregoing drawbacks in the conventional art.

It is an object of the present invention to provide precast modular units made of a construction material, such as concrete, that can be easily and economically transported to a construction site and erected.

Another object of the present invention is to provide a method and apparatus for forming precast modular units economically and efficiently using a construction material, such as concrete.

Another object of the present invention is to provide a precast modular structure having precast modular units which can enclose large interior spaces for storage or living.

A further object of the present invention is to provide a method for constructing a precast modular structure which increases the efficiency of on-site operation and which can be accomplished in a short period of time as compared to conventional construction methods.

The foregoing and other objects of the present invention are carried out by a precast modular unit system comprising a plurality of generally different precast modular unit sets each having a plurality of identical precast modular units. The precast modular units of each precast modular unit set have connecting surfaces each for connection to a corresponding connecting surface of one other identical precast modular unit or to a corresponding connecting surface of one of the precast modular units of another of the precast modular unit sets to construct a precast modular structure having a predetermined configuration.

Preferably, the precast modular units of each precast modular unit set are made from a construction material, such as concrete. Each precast modular unit of each precast modular unit set comprises a wall portion, a base portion extending from the wall portion, and connecting means disposed on the connecting surfaces for connecting the precast modular units to one another.

Preferably, the precast modular units of one of the precast unit sets comprise wall sections, and the precast modular units of another of the precast modular unit sets comprise corner sections. The connecting surfaces are disposed on right and left side surfaces of each of the wall and corner sections. Preferably, a plurality of reinforcing members are embedded in the wall and base portions of each of the sidewall and corner sections for reinforcing the sections.

In a first embodiment, each of the wall and corner sections has a flange portion extending from a surface thereof for strengthening the section. In a second embodiment, the base portion of each of the wall and corner sections comprises an inner base portion and an outer base portion extending inwardly and outwardly, respectively, from the wall portion. In a third embodiment, each of the wall and corner sections according to the second embodiment has a flange portion for strengthening the section.

In another aspect, the present invention is directed to an apparatus for forming precast modular units. The apparatus comprises at least two modular forms configured to be arranged and interconnected in spaced-apart relation to one another, a plurality of reinforcement members disposed in each of the modular forms, a plurality of connecting members each integrally connected to one of the reinforcement members and extending from side edges of each of the modular forms, and a molding plate configured to be arranged and interconnected between the modular forms.

Preferably, each of the modular forms comprises a pair of opposite, spaced-apart frames and a hollow stepped portion extending from the frames, the reinforcement members being disposed between the frames and in the hollow stepped portion. The frames, the hollow stepped portion and the reinforcement members of each of the modular forms define spaces within the modular form which are configured to receive and allow flow of a construction material, such as concrete, being poured therein to form the precast modular units.

In another aspect, the present invention provides a method of forming precast modular units. At least two modular forms are provided, each having side edges, a plurality of reinforcement members, and a plurality of connecting members each connected to one of the reinforcement members and extending from the side edges. The modular forms are positioned side by side so that one of the side edges of the modular forms is disposed in confronting, spaced-apart relation to a corresponding side edge of the other modular form. A molding plate for forming connecting surfaces is disposed between the confronting side edges of the modular forms. The connecting plates extending from the confronting side edges of the modular forms are then integrally connected to one another with the molding plate interposed therebetween. A construction material, such as concrete, is then poured into the modular forms and allowed to cure. The molding forms and the molding plate are then removed to form precast modular units having connecting surfaces.

In another aspect, the present invention provides a precast modular structure comprising a plurality of generally different precast modular unit sets each having a plurality of identical precast modular units. Each of the precast modular units of each precast modular unit set has connecting surfaces each connected to a corresponding connecting surface of an adjacent identical precast modular unit or to a corresponding connecting surface of an adjacent precast modular unit of another of the precast modular unit sets. Each of the connecting surfaces of each precast modular unit of each precast modular unit set has connecting means for connecting the connecting surface to the connecting surface of the adjacent precast modular unit.

Preferably, each precast modular unit of each precast modular unit set is made of concrete and comprises a wall portion and a base portion extending from the wall portion. The precast modular units are preferably arranged side by side and are connected to one another along the connecting surfaces so that the wall portions form a boxed-shaped structure having an open top and the base portions form a support base supporting the boxed-shaped structure. A floor structure is disposed inside of and in contact with inner lower edges of the boxed-shaped structure. Preferably, an alkali-reactive waterproof film is disposed between the floor structure and the inner lower edges of the boxed-shaped structure.

The connecting means of each of the connecting surfaces of the precast modular units preferably comprises connecting portions formed on the connecting surfaces of the precast modular units, connecting members extending from each of the connecting surfaces and connected to corresponding connecting members extending from a connecting surface of an adjacent precast modular unit, and a construction material, such as grout, disposed between the connecting portions and the connecting members for integrally connecting the adjacent precast modular units to one another. When the precast modular units are connected in this manner, a rigid joint is formed between each pair of adjacent precast modular units. A waterproof material is preferably disposed on an outer surface of each rigid joint.

In another aspect, the present invention is directed to a method for constructing a precast modular structure. A plurality of precast modular units each having a pair of connecting surfaces and made of a structural material, such as concrete, are transported to a construction site. The precast modular units are then erected by preferably disposing the precast modular units on unscreened gravel or sand disposed on flat support ground surfaces. The precast modular units are erected so that each of the connecting surfaces of each of the precast modular units is in confronting, spaced-apart relation to a corresponding connecting surface of an adjacent precast modular unit. The confronting connecting surfaces of adjacent precast modular units are then connected to one another to define a channel therebetween. A construction material, such as a grout, is then poured into each of the channels formed between each pair of adjacent precast modular units. The construction material is then allowed to cure to form rigid joints which integrally connect the precast modular units to one another to form a wall structure having a predetermined shape, an interior space, and interior and exterior wall surfaces having the rigid joints. A waterproof material is preferably then applied on each rigid joint at the exterior wall surface of the wall structure. The wall structure is then buried by placing soil, aggregate or other appropriate material against the exterior surface thereof. A floor structure is then formed by pouring a construction material, such as concrete, in the interior space of the wall structure. Preferably, an alkali-reactive waterproof film is attached to inner lower edges of the precast concrete modular units prior to pouring the concrete to form the floor structure.

In another aspect, the present invention is directed to a building structure comprising a precast modular structure as set forth above according to the present invention, a framework structure mounted on the precast modular structure, and a foundation disposed between the precast modular structure and the framework structure.

BRIEF DESCRIPTION OF THE DRAWINGS

The foregoing summary, as well as the following detailed description of the preferred embodiments of the invention, will be better understood when read in conjunction with the accompanying drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE PREFERRED EMBODIMENTS

Figure 1:
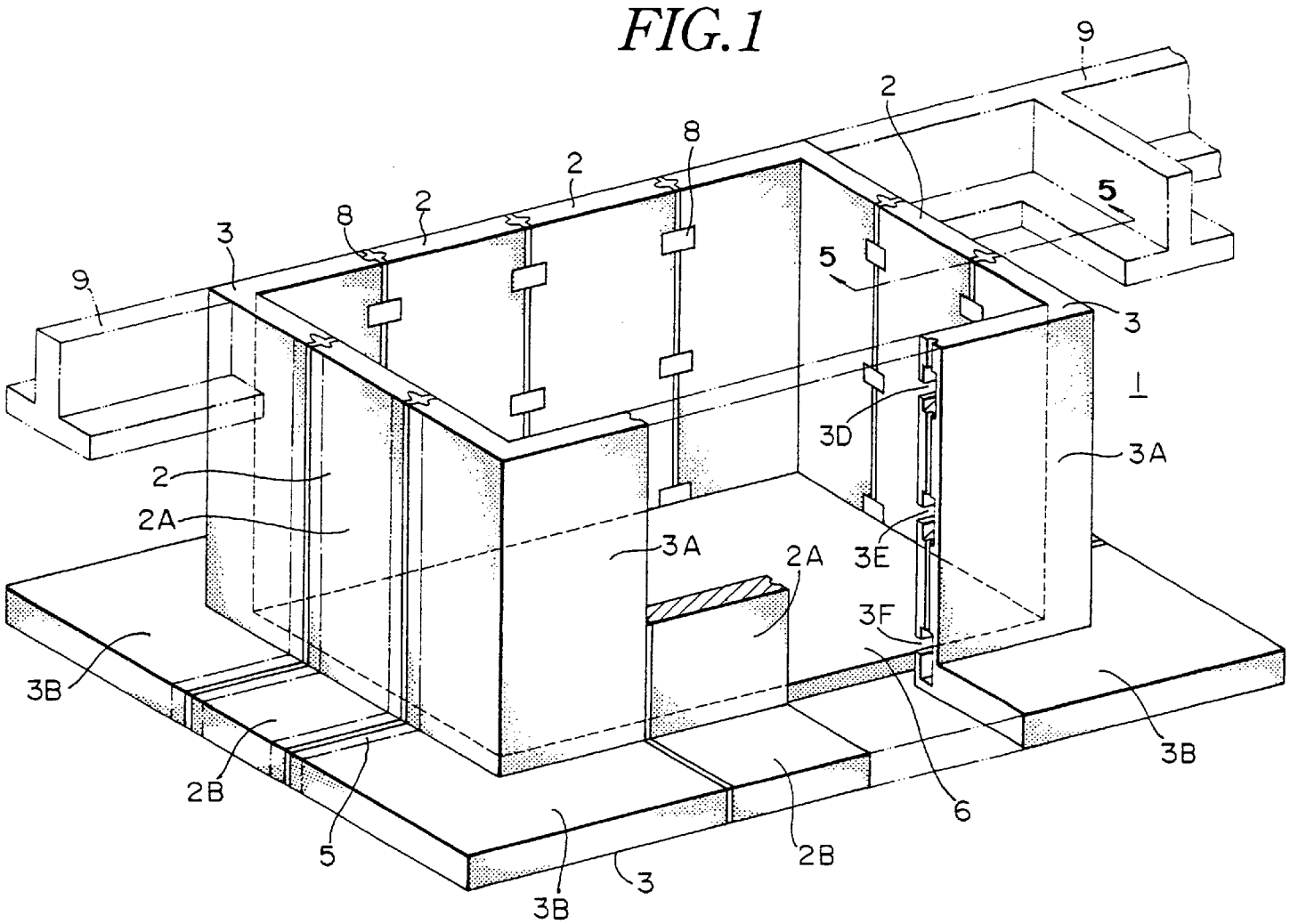
FIG. 1 is a partially cutaway perspective view of an embodiment of a precast modular structure according to the present invention.

The present invention relates generally to construction systems and methods which employ a plurality of connectable precast modular units which are transported to a construction site and erected to construct a precast modular structure. For illustrative purposes only, the present invention will be described with reference to precast modular units made of construction materials, such as concrete, and to precast modular structures constructed using the precast concrete modular units for use as a basement, a garage or a floor level suitable as a part of a dwelling, or for use as a fire cistern (snow-melting tank), a stilted foundation and the like. It is understood by those of ordinary skill in the art, however, that the particular use of precast concrete for the modular units, the particular use of the precast modular structures, and the configurations thereof shown are for illustrative purposes only and merely represent several of the multitude of different types of construction materials, structures and configurations thereof that can be realized according to the present invention. Thus the present invention is in no way limited or restricted to the particular construction materials, structures and configurations described and illustrated in the drawings.

Moreover, certain terminology is used in the following description for convenience only and is not intended to be limiting. For purposes of this description, the terms "vertical" and "horizontal" are merely illustrative of relative space positions of the various components in the drawings. In actual practice, it is apparent that the components can be aligned in either orientation. Moreover, the terms "upper", "middle", "lower", "front", "rear", "left", "right", "inner" and "outer" designate directions in the drawing to which reference is made. Such terminology includes the terms above specifically mentioned and words of similar import.

Various embodiments of the present invention will be described with reference to FIGS. 1–26 wherein like numerals designate like elements throughout.

FIG. 1 shows a precast modular structure 1 according to the present invention in the form of a basement, such as a general basement structure suitable as a part of a dwelling. The basement is constructed using a plurality of precast modular units 2 defining a first precast modular unit set, and a plurality of precast modular units 3 defining a second precast modular unit set. In the embodiments disclosed herein, the precast modular units 2, 3 comprise wall sections and corner sections, respectively, which can be transported to a construction site and erected as further described below to construct the basement 1. Preferably, the wall sections 2 and the corner sections 3 are all precast concrete reinforced with a suitable metal mesh reinforcement 13 (FIGS. 12–13) comprised of a plurality of metal reinforcement members 13A, 13B, such as steel.

Figure 2:
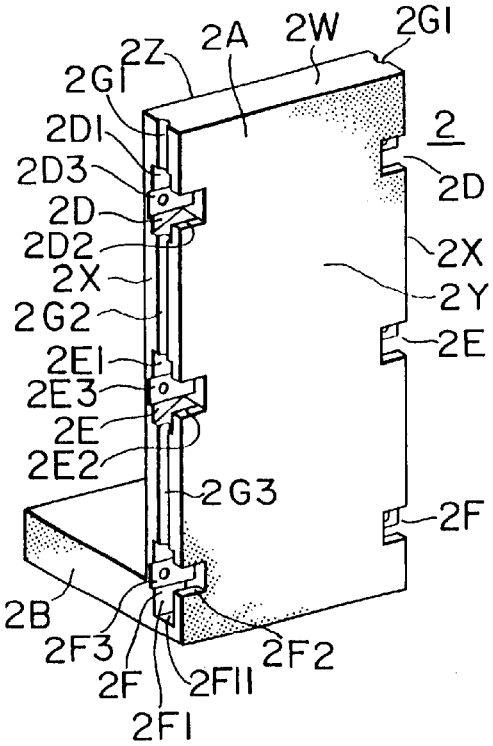
FIG. 2 is a perspective view of an embodiment of a precast modular unit according to the present invention.

FIG. 2 shows a first embodiment of the precast concrete wall sections 2 according to the present invention. Each of the wall sections 2 comprises an elongated wall portion 2A and a base portion or footing 2B integral with the wall portion. The wall portion 2A is generally rectangular-shaped in cross-section and has an upper surface 2W, left and right end surfaces 2X, an inner surface 2Y and an outer surface 2Z. Each of the end surfaces 2X comprises a connecting surface having upper, middle and lower connecting portions 2D, 2E, 2F, respectively. Three generally plate-shaped connecting members 2D3, 2E3, 2F3 (hereinafter referred to as "connecting plates") protrude from each of the connecting surfaces 2X. As described in detail below, the connecting portions 2D, 2E, 2F and the connecting plates 2D3, 2E3, 2F3, together with a construction material, such as a grout or thin mortar, form a rigid joint for connecting each of the connecting surfaces 2X of the wall section 2 to a corresponding connecting surface of another wall section 2 or one of the corner sections 3.

Figure 4:
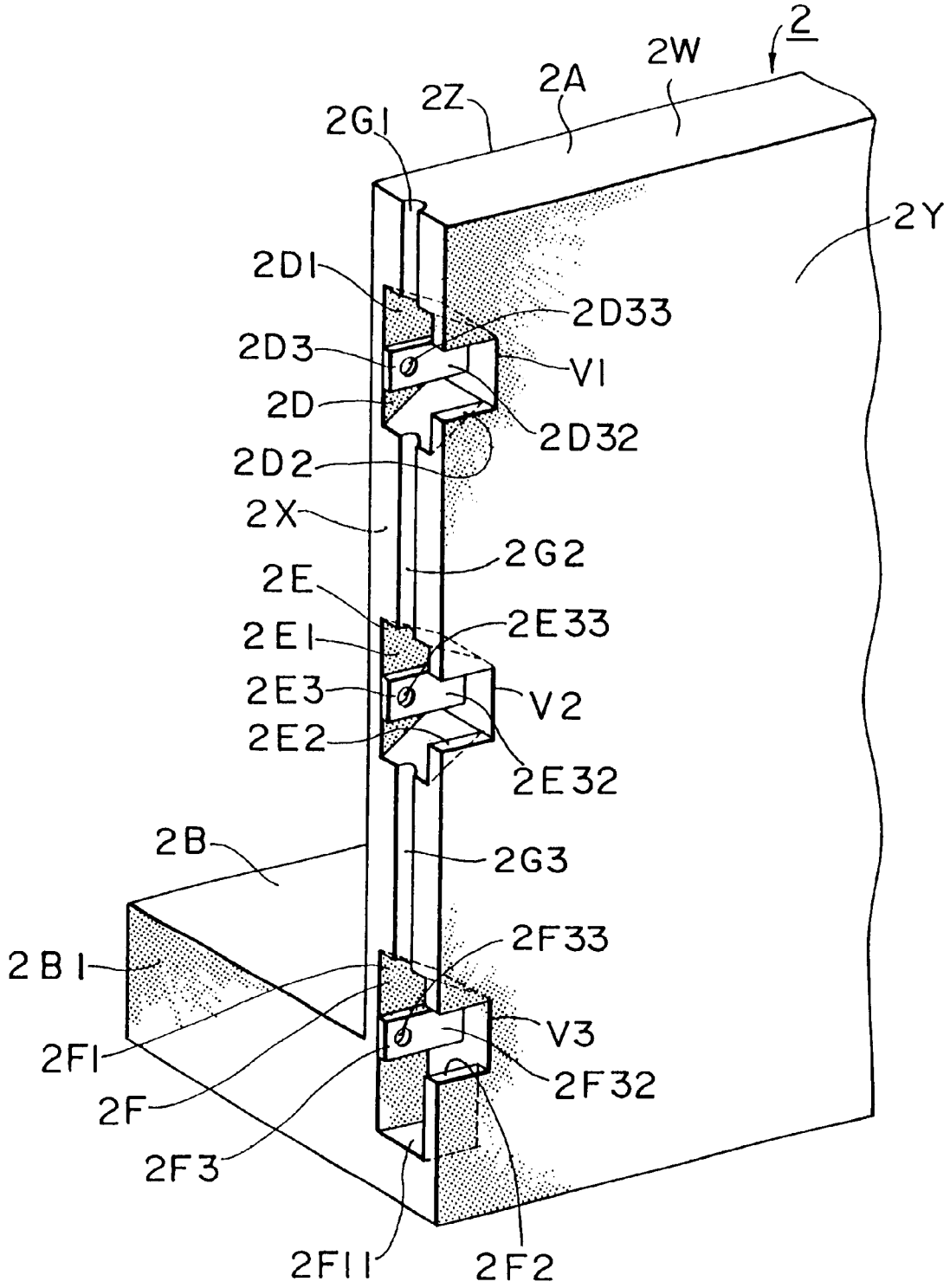
FIG. 4 is an enlarged perspective view of upper, middle and lower connecting portions of the precast modular unit shown in FIG. 2.

FIG. 4 shows an enlarged perspective view of the left connecting surface 2X of the wall section 2 having the upper, middle and lower connecting portions 2D, 2E and 2F. The upper connecting portion 2D comprises a generally V-shaped cavity V1 and a first groove 2G1. The cavity V1 comprises a first recess 2D1 extending vertically on the connecting surface 2X and a second recess 2D2 extending horizontally on the connecting surface 2X and in communication with the first recess 2D1. The first groove 2G1 is generally C-shaped in cross-section and extends from the upper surface 2W to the cavity V1. The connecting plate 2D3 has a first end portion 2D31 integrally connected to one of the reinforcement members 13B of the metal mesh reinforcement 13 (FIG. 13), and a second end portion 2D32 protruding outwardly from the connecting surface 2X. The second end portion 2D32 of the connecting plate 2D3 has a connecting hole 2D33 for receiving a fastener B (FIG. 13) for connecting the connecting plate 2D3 to a corresponding connecting plate of another wall section 2 or one of the corner sections 3.

The middle connecting portion 2E has a generally V-shaped cavity V2 and a second groove 2G2. The cavity V2 comprises a first recess 2E1 extending vertically on the connecting surface 2X and a second recess 2E2 extending horizontally on the connecting surface 2X and in communication with the first recess 2E1. The second groove 2G2 is generally C-shaped in cross-section and extends from the first cavity V1 to the second cavity V2 in aligned relation to the first groove 2G1. The connecting plate 2E3 has a first end portion 2E31 integrally connected to another reinforcement member 13B of the metal mesh reinforcement 13, and a second end portion 2E32 protruding outwardly from the connecting surface 2X. The second end portion 2E32 of the connecting plate 2E3 has a connecting hole 2E33 for receiving another fastener B for connecting the connecting plate 2E3 to the corresponding connecting plate of another wall section 2 or one of the corner sections 3.

The lower connecting portion 2F has a cavity V3 and a third groove 2G3. The cavity V3 comprises a first recess 2F1 extending vertically on the connecting surface 2X, a second recess 2F2 extending horizontally on the connecting surface 2X and in communication with the first recess 2F1, and a third recess 2F11 extending vertically on the connecting surface 2X and in communication with the first and second recesses 2F1, 2F2. The third groove 2G3 is generally C-shaped in cross-section and extends from the second cavity V2 to the third cavity V3 in aligned relation to the first and second grooves 2G1, 2G2. The connecting plate 2F3 has a first end portion 2F31 integrally connected to another reinforcement member 13B of the metal mesh reinforcement 13, and a second end portion 2F32 protruding outwardly from the connecting surface 2X. The second end portion 2F32 of the connecting plate 2F3 has a connecting hole 2F33 for receiving another fastener B for connecting the connecting plate 2F3 to the corresponding connecting plate of another wall section 2 or one of the corner sections 3.

From the foregoing construction, it will be appreciated that the connecting portions 2D, 2E, 2F on each of the connecting surfaces 2X of the wall section 2 form a series of cavities V1, V2, V3 extending along the connecting surface for receiving a construction material, such as grout or a thin mortar, and a series of grooves 2G1, 2G2, 2G3 for interconnecting the cavities to allow the flow of grout being poured to reach the cavities.

The structure of the right connecting surface 2X of the wall section 2 and corresponding connecting plates 2D3, 2E3, 2F3 in FIG. 2 is identical to those of the left connecting surface 2X and corresponding connecting plates described above. Therefore, a detailed description thereof need not be set forth.

Figure 3:
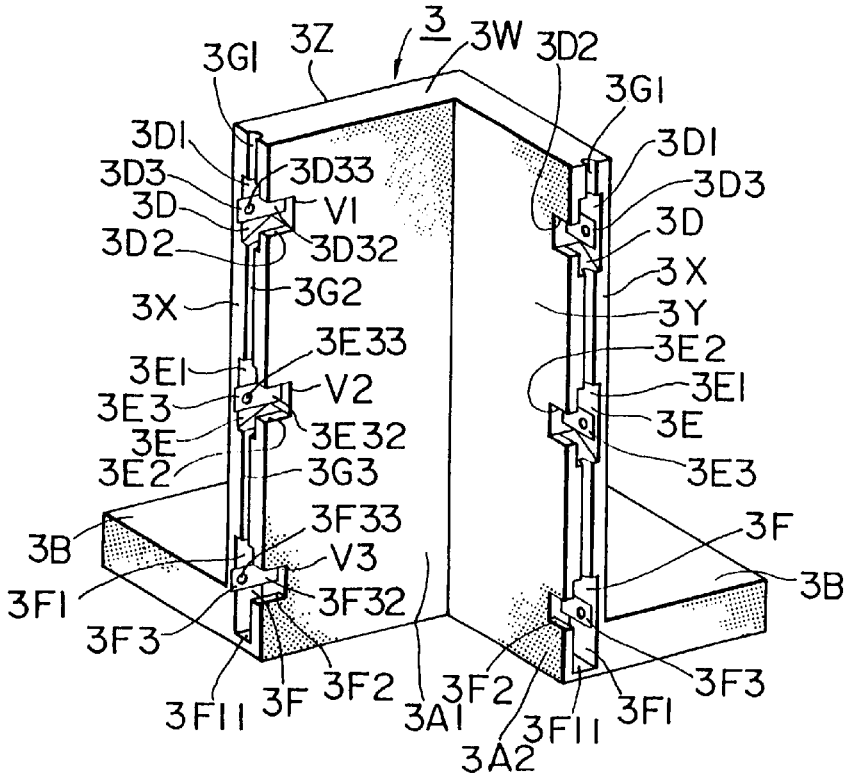
FIG. 3 is a perspective view of another embodiment of the precast modular unit according to the present invention.

FIG. 3 shows a first embodiment of the precast concrete corner sections 3 according to the present invention. Each of the corner sections 3 comprises right angle wall portions 3A1, 3A2 with an integral base or footing 3B. The wall portions 3A1, 3A2 are generally rectangular in cross-section and have an upper surface 3W, left and right end surfaces 3X, an inner surface 3Y and an outer surface 3Z. Each of the left and right end surfaces 3X comprises a connecting surface having upper, middle and lower connecting portions 3D, 3E, 3F, respectively. Three connecting plates 3D3, 3E3, 3F3 protrude from each of the connecting surfaces 3X. The structure of the left and right connecting surfaces 3X and connecting plates 3D3, 3E3, 3F3 is identical to the structure of the left and right connecting surfaces 2X and connecting plates 2D3, 2E3, 2F3 described above for the embodiment of the wall section 2 shown in FIG. 2. Therefore, a detailed description thereof need not be set forth. In FIG. 3, the various parts of the structure of the left and right connecting surfaces 3X and connecting plates 3D3, 3E3, 3F3 are designated as follows: cavities V1, V2, V3; first recesses 3D1, 3E1, 3F1; second recesses 3D2, 3E2, 3F2; third recess 3F11; second end portions 3D32, 3E32, 3F32 of the connecting plates; connecting plate holes 3D33, 3E33, 3F33; and grooves 3G1, 3G2, 3G3.

As described in detail below, the connecting portions 3D, 3E, 3F and the connecting plates 3D3, 3E3, 3F3, together with a construction material, such as a grout or thin mortar, form rigid joints for connecting the left and right connecting surfaces 3X of the corner section 3 to corresponding connecting surfaces of another corner section 3 or one of the wall sections 2.

A method of constructing a precast modular structure, such as the basement shown in FIG. 1, using the precast wall sections 2 and precast corner sections 3 according to the present invention will now be described with reference to FIGS. 5–7.

Figure 5:
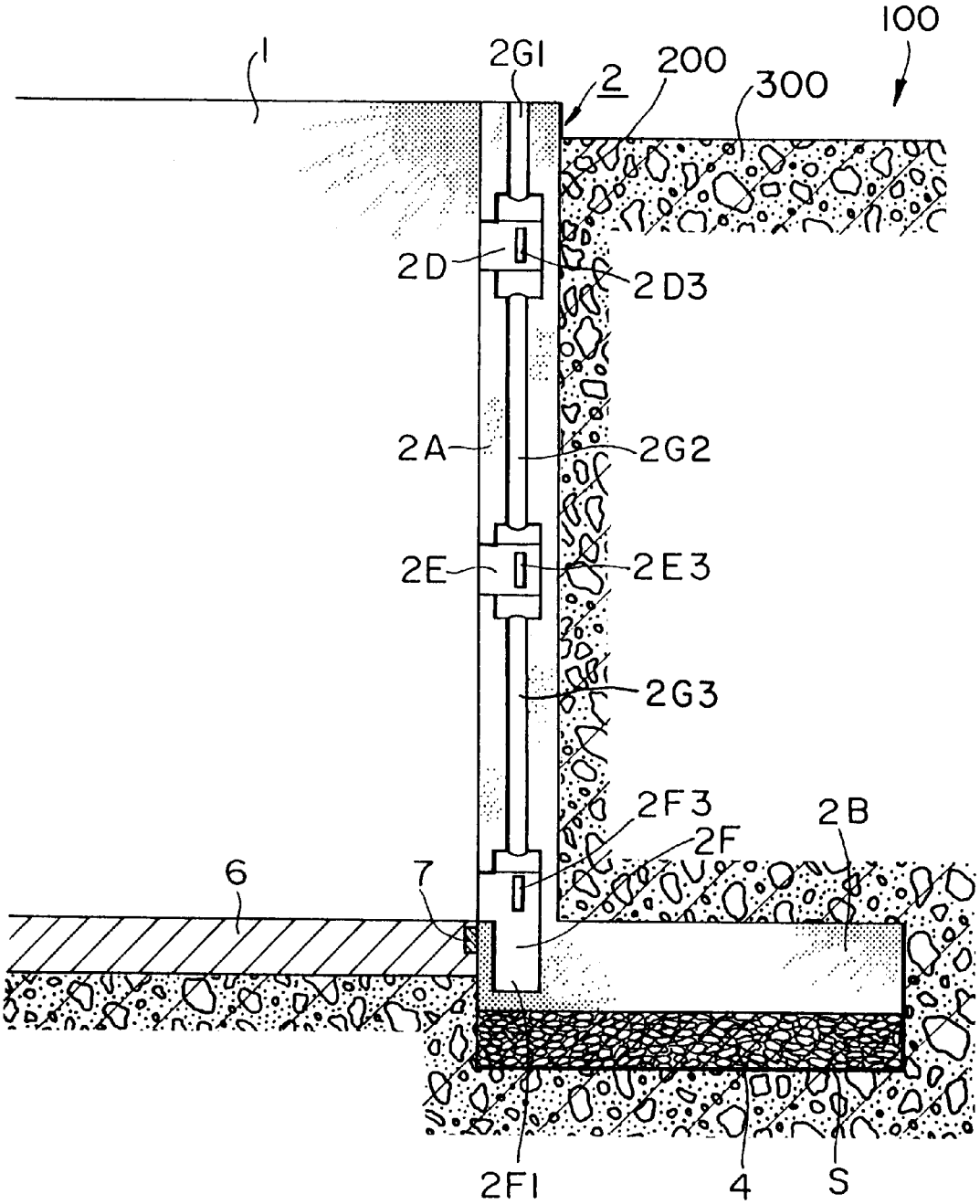
FIG. 5 is an enlarged cross-sectional view taken along line 5—5 of FIG. 1.

The precast concrete wall and corner sections 2, 3 are prepared at a factory and then transported to a construction site 100 as shown in FIG. 5. At the construction site 100, an appropriate excavation 200 is made for the basement, and flat surfaces S for supporting the footings 2B, 3B of the wall and corner sections 2, 3, respectively, are provided. The flat support surfaces S are preferably compacted and then covered with a compacted aggregate 4, such as unscreened gravel or sand. The wall sections 2 and the corner sections 3 are then positioned on the flat support surfaces S in a predetermined configuration so that the respective connecting surfaces 2X, 3X are in spaced-apart, confronting relation to corresponding connecting surfaces of adjacent wall sections 2 and/or corner sections 3. For example, as shown in FIGS. 6 and 7, two wall sections 2 which are to be connected to one another are arranged so that the connecting surface 2X of the sidewall portion 2A and a side surface 2B1 (FIG. 4) of the footing 2B of one of the wall sections 2 are disposed in spaced-apart, confronting relation to the corresponding connecting surface and side surface, respectively, of the adjacent wall section 2. The adjacent wall sections 2 are positioned in this manner until the connecting plates 2D3, 2E3, 2F3 on the connecting surface 2X of one of the wall sections 2 overlap the connecting plates 2D3, 2E3, 2F3, respectively, on the connecting surface 2X of the adjacent wall section 2, and the connecting holes 2D33, 2E33, 2F33 of the connecting plates are respectively aligned with one another. Each pair of overlapping connecting plates 2D3, 2E3, 2F3 is then integrally connected together by a fastening member, such as a bolt B, to thereby integrally connect the connecting surfaces 2X of the adjacent wall sections 2 together in spaced-apart relation.

When the adjacent wall sections 2 are positioned and connected as described above, the confronting connecting surfaces 2X and side surfaces 2B1 of the adjacent wall sections 2 cooperate to form a channel C which extends vertically from the upper surfaces 2W to the third recesses 2F11 and horizontally across a width of the footings 2B of the wall sections 2. Furthermore, the cavities V1, V2, V3 of the wall sections 2 are in respective confronting relation with one another and form generally rectangular-shaped openings R, as shown in FIG. 6.

Figure 6:
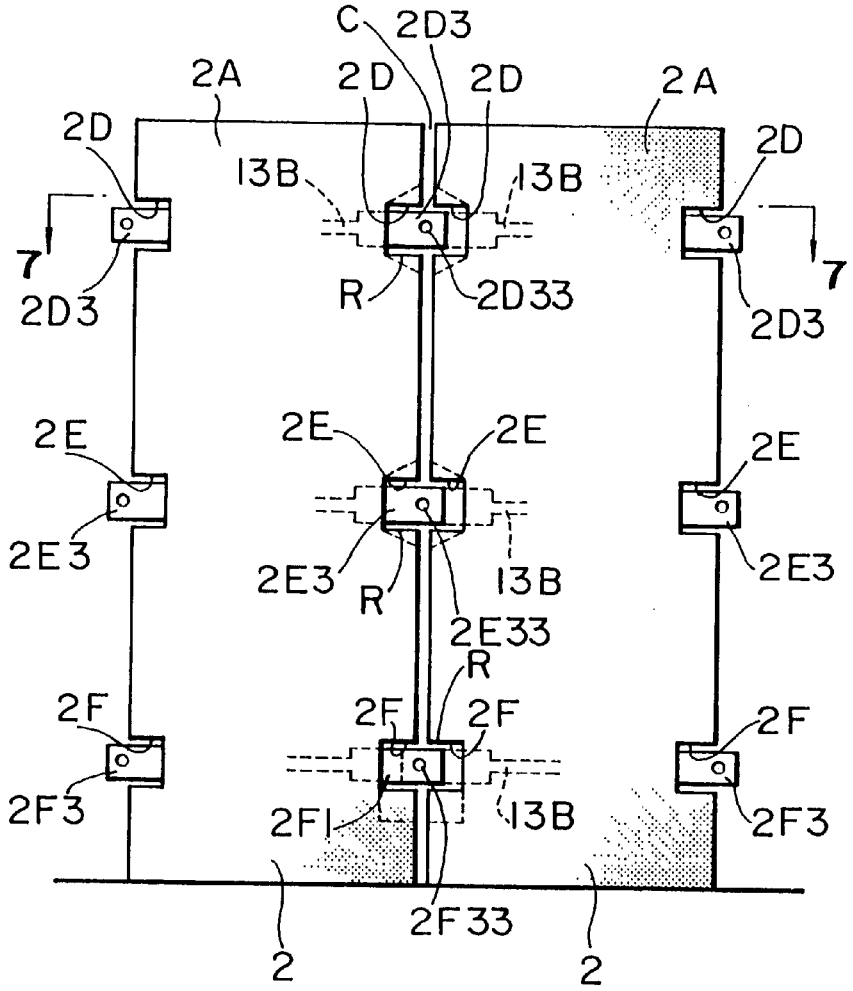
FIG. 6 is a front view illustrating the state of connection of two of the precast modular units shown in FIG. 2.
Figure 7:
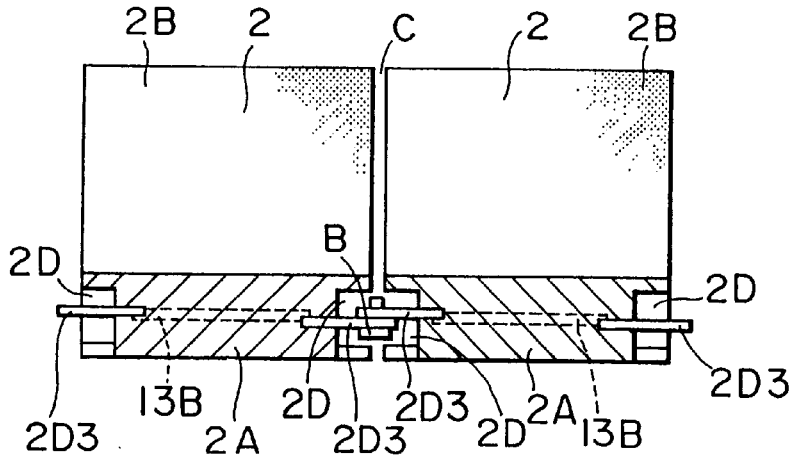
FIG. 7 is an enlarged cross-sectional view taken along line 7—7 of FIG. 6.

The remaining wall sections 2 and the corner sections 3 are connected to adjacent wall sections 2 and/or corner sections 3 in the same manner as described above for the two adjacent wall sections 2 shown in FIGS. 6 and 7. The wall sections 2 and the corner sections 3 are preferably connected to one another as described above after all of the wall sections 2 and corner sections 3 have been disposed on the support surfaces S in the predetermined configuration, such as is shown in FIG. 1. Alternatively, the adjoining wall sections 2 and/or corner sections 3 are connected to one another immediately after all of the wall sections 2 and corner sections 3 have been positioned on the support surfaces S.

After the adjacent wall sections 2 are positioned and connected as described above, a construction material 8, such as a grout or thin mortar, is poured into each of the channels C formed between adjacent wall sections 2 and/or corner sections 3 and allowed to cure to thereby form rigid joints which integrate wall sections 2 and corner sections 3 to one another. For example, when the construction material 8 is poured in the channel C formed between adjacent wall sections 2, the material 8 is allowed to flow and settle in the grooves 2G1, 2G2, 2G3, in the cavities V1, V2, V3, around the connecting plates 2D3, 2E3, 2F3 and in the space formed between confronting side surfaces 2B1 of the footings 2B of the adjacent wall sections 2, and the material is then allowed to cure to integrally connect the wall sections 2 to one another. In this state, the cavities V1, V2, V3, the grooves 2G1, 2G2, 2G3, the connecting plates 2D3, 2E3, 2F3 and the cured construction material 8 form a rigid joint which, together with the metal mesh reinforcement 13 embedded in each section, will hold the connected sections in a vertical position and will also prevent horizontal separation.

After the wall sections 2 and the corner sections 3 are integrated as described above to construct the basement 1 shown in FIG. 1, a coating that will prevent the absorption of water, such as a sealant or waterproof material 5, is applied on the outer surface of each rigid joint formed between each adjacently connected wall sections 2 and/or corner sections 3. As shown in FIG. 5, soil, aggregate or other appropriate material 300 is then placed against the outside surfaces 2Z, 3Z and the footings 2B, 3B of the wall sections 2 and corner sections 3, respectively, to a desired ground level. Thereafter, an alkali-reactive waterproof film 7 is attached to inner lower edge portions of the wall sections 2 and corner sections 3, and a floor structure 6 is formed in the area surrounded by the wall and corners sections by pouring concrete or other suitable method. A proper foundation 9 is then constructed around upper exterior surface portions of the wall sections 2 and corner sections 3 to provide a support base for the construction of a building structure, such as a dwelling, over the basement 1.

By the foregoing method, the wall sections 2 and the corner sections 3 having integral footings 2B, 3B, respectively, are integrally connected to one another and are firmly supported on the support surfaces S by the pressure of the soil, aggregate or other appropriate material 300 surrounding the outer surfaces 2Z, 3Z and footings 2B, 3B of the wall and corner sections. Accordingly, concrete beams and/or reinforcing floor structures are not required in the interior area surrounded by the wall sections 2 and corner sections 3. Thus the basement 1 according to the present invention can be constructed using precast wall sections and corner sections and can enclose large interior spaces for storage or living.

Figure 8:
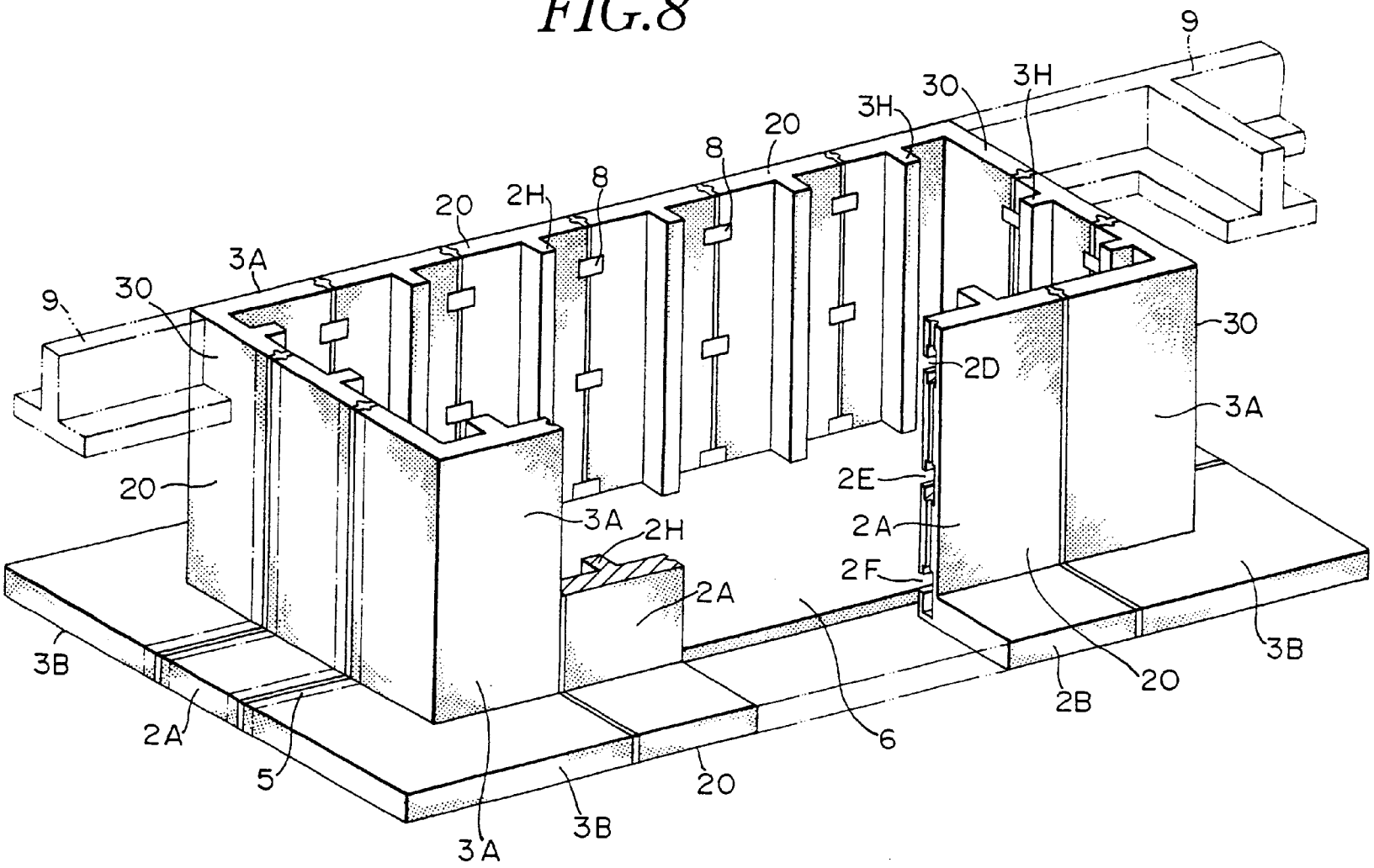
FIG. 8 is a partially cutaway perspective view of another embodiment of the precast modular structure according to the present invention.
Figure 9:
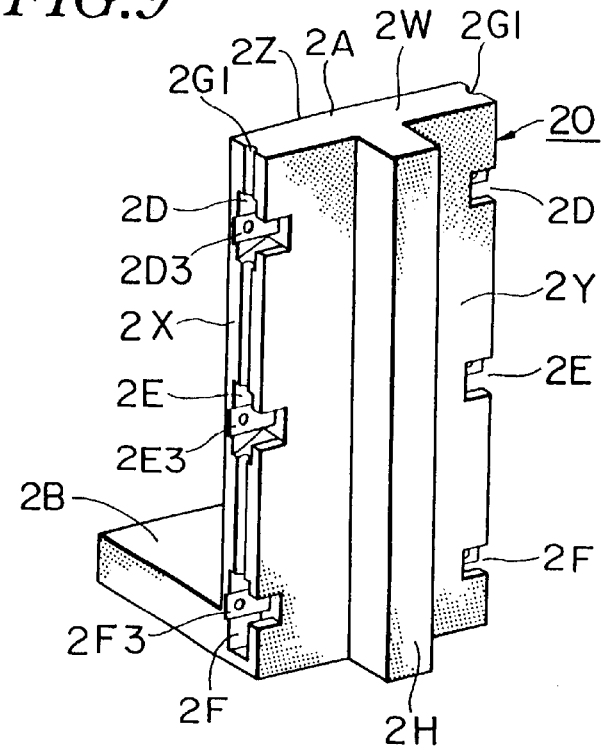
FIG. 9 is a perspective view of another embodiment of the precast modular unit according to the present invention.
Figure 10:
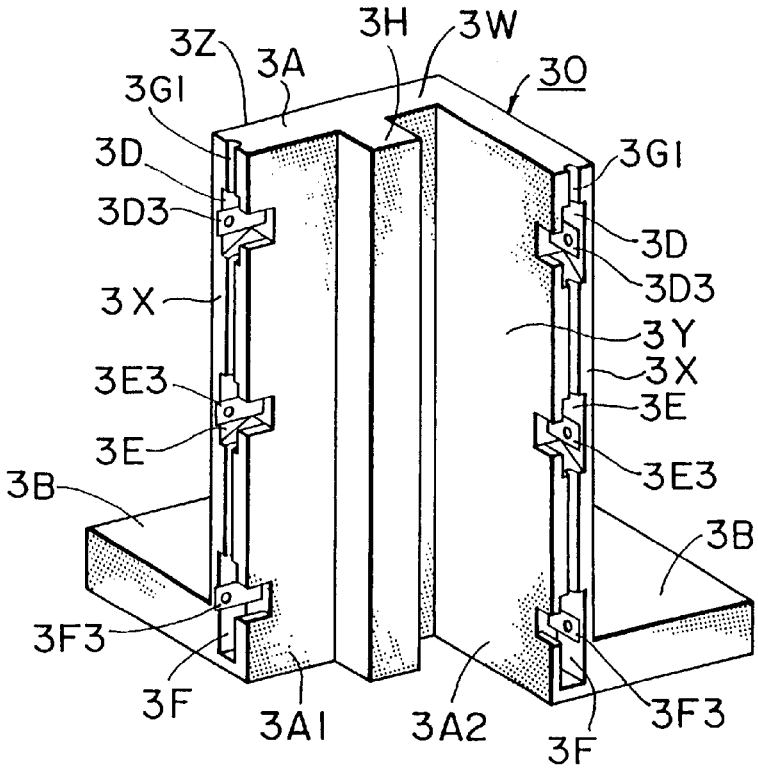
FIG. 10 is a perspective view of another embodiment of the precast modular unit according to the present invention.

FIG. 8 shows a precast modular structure, in the form of a basement, according to another embodiment of the present invention. FIGS. 9–10 show other embodiments of a precast wall section 20 and a precast corner section 30 for constructing the basement shown in FIG. 8.

Referring to FIGS. 9 and 10, the precast wall section 20 and the precast corner section 30 comprise substantially all of the elements described above for the embodiments of the wall section 2 and the corner section 3 shown in FIGS. 2 and 3, respectively. However, the wall section 20 further comprises an integral vertical flange portion 2H extending from the inner surface 2Y for strengthening the wall section 20. The corner section 30 further comprises an integral vertical flange portion 3H extending from the inner surface 3Y of the wall portion 3A1 for strengthening the corner section 30. The flange portions 2H, 3H provide sufficient structural strength to the wall sections 20 and corner sections 30, respectively, when the soil, aggregate or other appropriate material 300 applies a large pressure to the outer surfaces 2Z, 3Z of the wall and corner sections.

The method of integrally connecting adjacent wall sections 20 and/or corner sections 30 and the method of constructing the basement shown in FIG. 8 using the wall sections 20 and corner sections 30 are the same as described above for the embodiment shown in FIGS. 1–7. Therefore, a detailed description thereof need not be set forth.

Figure 11:
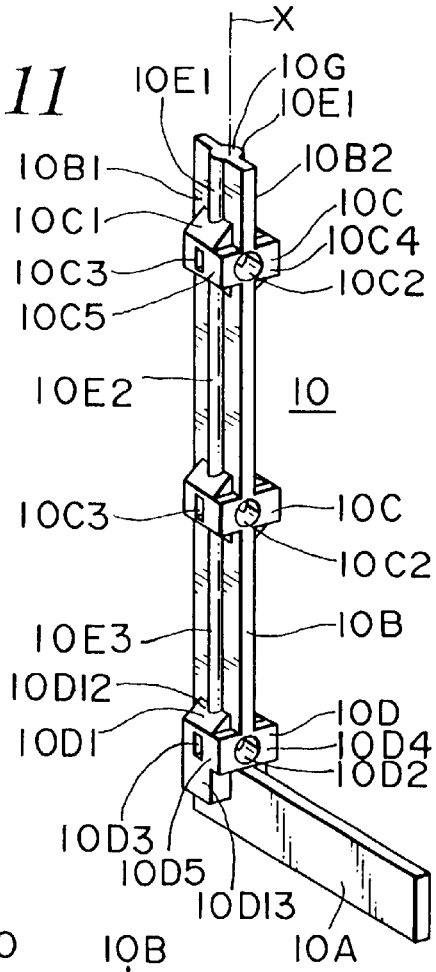
FIG. 11 is a perspective view of an embodiment of a molding plate for forming the precast modular units according to the present invention.

A method of forming two of the precast concrete wall sections 2 according to the present invention will now be described with reference to FIGS. 11–13.

Figure 12:
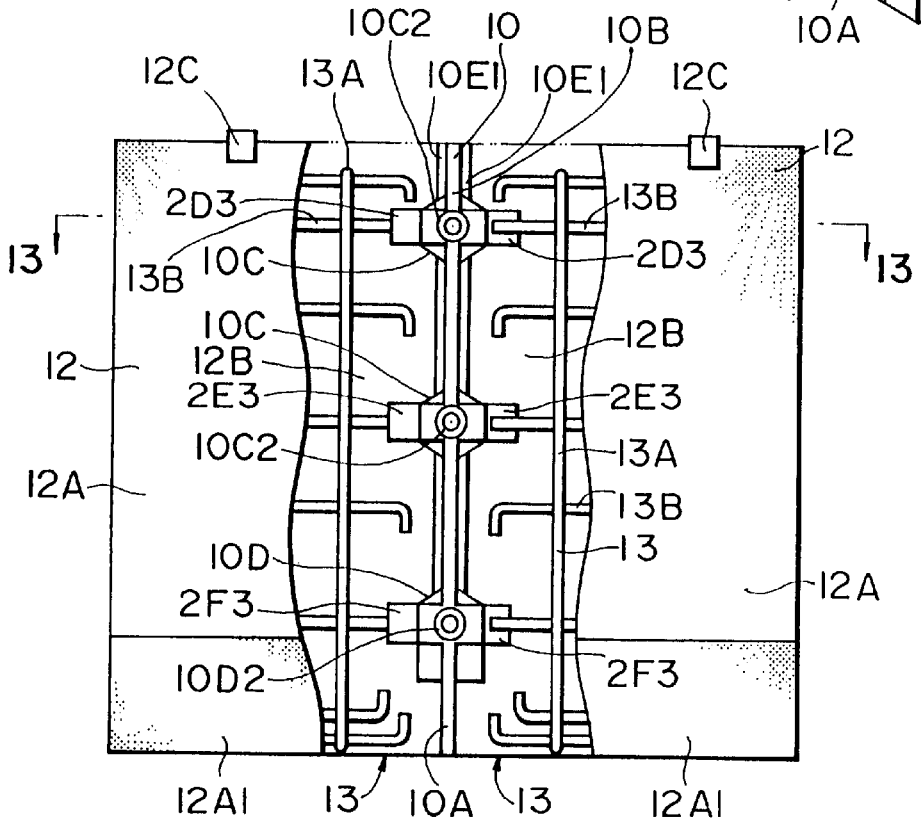
FIG. 12 is a partially cutaway rear view illustrating a method of using modular forms and the molding plate of FIG. 11 to form the precast modular units of the present invention.

A shown in FIG. 12, a pair of modular forms or molds 12, 12 are configured to be arranged and interconnected to one another in spaced-apart relation for forming the two wall sections 2. Each mold 12 comprises an outer frame 12A, an inner frame 12B disposed in opposite, spaced-apart relation to the outer frame 12A, spacing members 12C for maintaining the inner and outer frames in spaced-apart relation, and a hollow stepped portion 12A1 disposed at a lower end portion of the mold 12. The spaced-apart inner and outer frames 12A, 12B of the mold 12 are configured for forming the wall portion 2A of the wall sections 2. The stepped portion 12A1 of the mold 12 is configured for forming the footing 2B of the wall sections 2. The space between the inner and outer frames 12A, 12B and the hollow stepped portion 12A1 encase the metal mesh reinforcement 13. For each of the molds 12, the connecting plates 2D3, 2E3, 2F3 are integrally connected to one of the reinforcement members 13B, such as by welding, so that the second end portion 2D32, 2E32, 2F32 of the connecting plates having the connecting holes 2D33, 2E33, 2F33, respectively, protrude from the side edges of the mold.

A molding plate 10 is configured to be arranged and interconnected between the molds 12, 12 for forming the connecting surfaces 2X of the wall portions 2A and the side surfaces 2B1 of the footings 2B during formation of the wall sections 2. As shown in FIG. 11, the molding plate 10 comprises a base plate 10A for forming the side surfaces 2B1 of the footings 2B, and a vertical plate 10B extending upwardly from the base plate 10A for forming the connecting surfaces 2X of the wall portions 2A. The vertical plate 10B has side surfaces 10B1, 10B2, a central axis X, upper, middle and lower blocks 10C, 10C and 10D, respectively, and upper, middle and lower projections 10E1, 10E2 and 10E3, respectively.

Each of the blocks 10C of the molding plate 10 is comprised of a horizontal hexagonal columnar block body 10C1 having a front surface 10C4 and side surfaces 10C5. Each of the block bodies 10C1 extend from the side surfaces 10B1, 10B2 symmetrically about the central axis X of the vertical plate 10B. Each symmetrical portion of the block bodies 10C1 is generally V-shaped for forming the generally V-shaped cavities V1, V2 on the left and right connecting surfaces 2X of the wall sections 2. A first hole 10C2 extends through the front surface 10C4 of each of the block bodies 10C1 in a direction generally perpendicular to the central axis X. A second hole 10C3 extends through each of the side surfaces 10C5 of the block bodies 10C1 in a direction generally perpendicular to the first hole 10C2 and the central axis X.

The block 10D of the molding plate 10 comprises a block body 10D1 having an upper portion 10D12 and a lower portion 10D13 extending from the side surfaces 10B1, 10B2 symmetrically about the central axis X of the vertical plate 10B. The upper portion 10D12 has a front surface 10D4, side surfaces 10D5, and a horizontal half-hexagonal columnar shape for forming the recesses 2F1, 2F2 of the cavity V3 on the left and right connecting surfaces 2X of the wall sections 2. The lower portion 10D13 has a prismatic columnar shape and overlaps an end surface portion of the base plate 10A for forming the recesses 2F11 of the cavity V3 on the left and right connecting surfaces 2X of the wall sections 2. A first hole 10D2 extends through the front surface 10D4 of the block body 10D1 in a direction generally perpendicular to the central axis X. A second hole 10D3 extends through each of the side surfaces 10D5 of the block body 10D1 in a direction generally perpendicular to the first hole 10D2 and the central axis X.

Each pair of upper, middle and lower projections 10E1, 10E2, 10E3, respectively, extends from the side surfaces 10B1, 10B2 symmetrically about the central axis X of the vertical plate 10B. The upper projections 10E1 are disposed between the block 10C and an upper end 10G of the vertical plate 10B. The middle projections 10E2 are disposed between the upper block 10C and the middle block 10C. The lower projections 10E3 are disposed between the middle block 10C and the lower block 10D. Each of the projections 10E1, 10E2, 10E3 is generally C-shaped in cross-section for forming the generally C-shaped grooves 2G1, 2G2, 2G3, respectively, on the left and right connecting surfaces 2X of the wall sections 2.

Preferably, the molds 12, 12 and the molding plate 10 are made of extruded polymeric material. However, it is understood by those of ordinary skill in the art that other materials, such as wood, aluminum or stainless steel, are also suitable materials for the molds 12, 12 and the molding plate 10.

To construct the wall sections 2, the molds 12, 12 are positioned side by side so that side edges of the molds are in confronting, spaced-apart relation to each other, as shown in FIG. 12. In this position, the connecting plates 2D3, 2E3, 2F3 of one of the molds 12 are also in confronting, spaced-apart relation with the corresponding connecting plates 2D3, 2E3, 2F3 of the other mold 12. The molding plate 10 is then interposed between the opposing side edges of the molds 12, 12 so that each of the side surfaces 10B1, 10B2 of the vertical plate 10B confronts the respective side edge of the molds, and the base plate 10A is disposed between the stepped portions 12A1 of the molds. Thereafter, the confronting connecting plates 2D3, 2E3, 2F3 are temporarily connected to one another, while the molding plate 10 is interposed between the side edges of the molding plates as described above, in order to integrate the molds 12, 12 prior to pouring concrete in the molds to form the wall sections 2.

Figure 13:
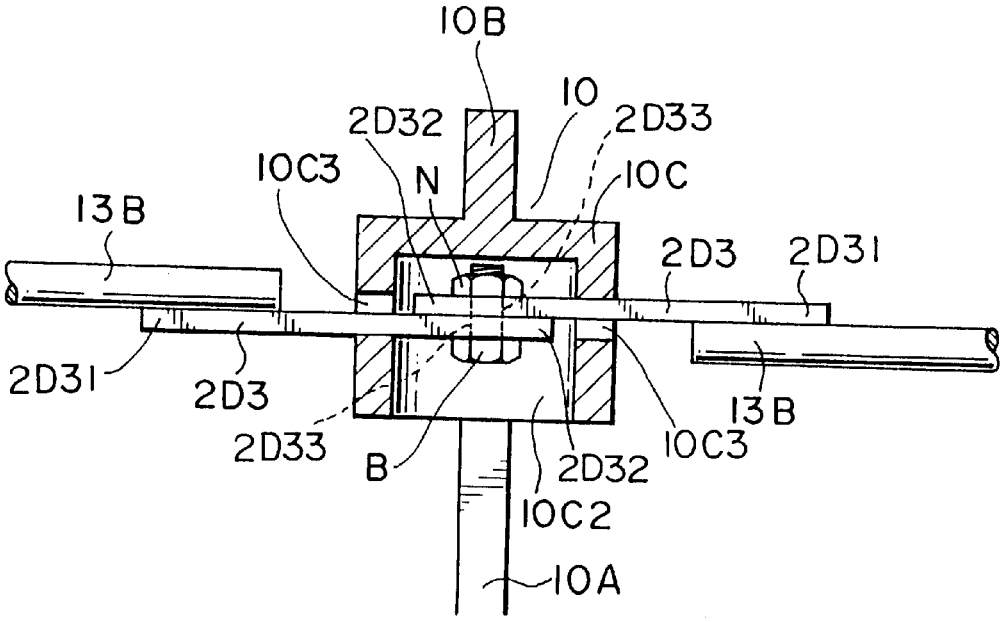
FIG. 13 is an enlarged cross-sectional view taken along line 13—13 of FIG. 12.

FIG. 13 is a cross-sectional view taken along line 13—13 in FIG. 12 showing how the confronting connecting plates 2D3 are temporarily connected to one another while the molding plate 10 is interposed between the side edges of the molding plates. The end portions 2D32 of the confronting connecting plates 2D3 are respectively passed through the second holes 10C3 of the upper block 10C of the molding plate 10 so that the connecting holes 2D33 are positioned inside the first hole 10C2 of the upper block 10C. In this position, the connecting plates 2D3 are in overlapping relation so that the connecting holes 2D33 formed on the end portions 2D32 are aligned with one another. The connecting plates 2D3 are then temporarily connected to one another using suitable connecting elements, such as a threaded bolt B and a nut N.

Each pair of confronting connecting plates 2E3 and 2F3 are respectively connected to one another in the same manner as described above for the connecting plates 2D3. More specifically, the end portions 2E32 of the confronting connecting plates 2E3 are respectively passed through the second holes 10C3 of the middle block 10C of the molding plate 10 so that the connecting holes 2E33 are positioned inside the first hole 10C2 of the middle block 10C. In this position, the connecting plates 2E3 are in overlapping relation so that the connecting holes 2E33 formed on the end portions 2E32 are aligned with one another. Likewise, the end portions 2F32 of the confronting connecting plates 2F3 are respectively passed through the second holes 10D3 of the lower block 10D of the molding plate 10 so that the connecting holes 2F33 are positioned inside the first hole 10D2 of the lower block 10D. In this position, the connecting plates 2F3 are in overlapping relation so that the connecting holes 2F33 formed on the end portions 2F32 are aligned with one another. The respective connecting plates 2E3 and 2F3 are then temporarily connected to one another using suitable nut and bolt connecting elements as described above for connecting plates 2D3.

By the foregoing construction and connecting method, the molds 12, 12 are integrally connected to one another with the molding plate 10 interposed therebetween. After the molds 12, 12 and the molding plate 10 are assembled as described above, concrete is poured into the molds 12, 12. After the concrete is allowed to cure, the molds 12, 12 and the molding plate 10 are removed to obtain two of the precast wall sections 2 shown in FIG. 2.

The foregoing description sets forth a method according to the present invention for forming two of the wall sections 2. It is understood by those of ordinary skill in the art, however, that more than two wall sections 2 can be formed in a single forming operation. For example, three or more of the molds 12 can be arranged side by side in a horizontal row, and adjacent molds 12 are integrally connected to one another with one of the molding plates 10 interposed therebetween in the manner described above. After the concrete is poured into each of the molds 12 and allowed to cure, the molds and the connecting plates 10 are removed to obtain the precast wall sections 2.

The structure of the molds and the method of forming the precast wall sections 20 and the corner sections 3, 30 are substantially the same as described above for the precast wall sections 2. The only difference is in the structure of the molds used to form the wall sections 20, which have the flange portion 2H, and the corner sections 3, 30, which have the angled wall portions 3A1, 3A2 (corner sections 3, 30) and the flange portion 3H (corner section 30). The structure of the molding plate for forming the connecting portions 2D, 2E, 2F of the wall sections 20 and the connecting portions 3D, 3E, 3F of the corner sections 3, 30 is identical to the structure of the molding plate 10 described above for the formation of the connecting portions 2D, 2E, 2F of the precast wall sections 2.

Figure 15:
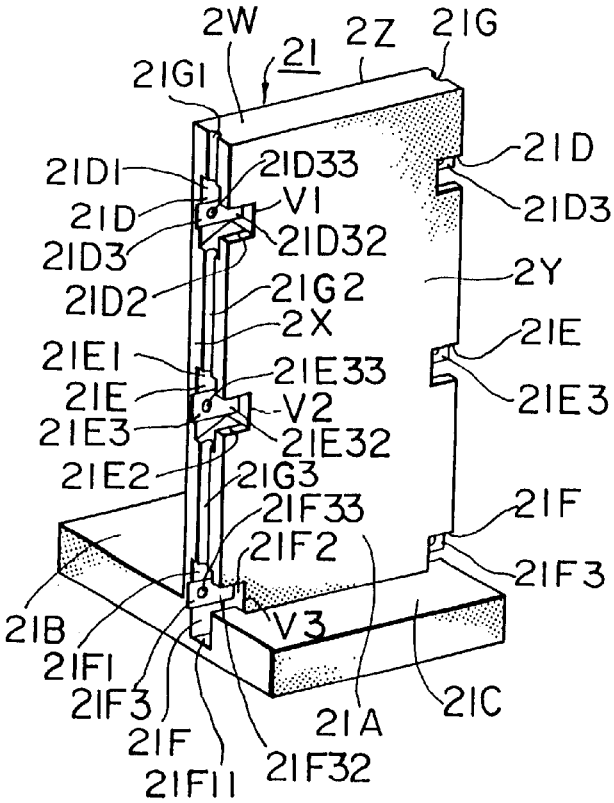
FIG. 15 is a perspective view of another embodiment of the precast modular unit according to the present invention.
Figure 14:
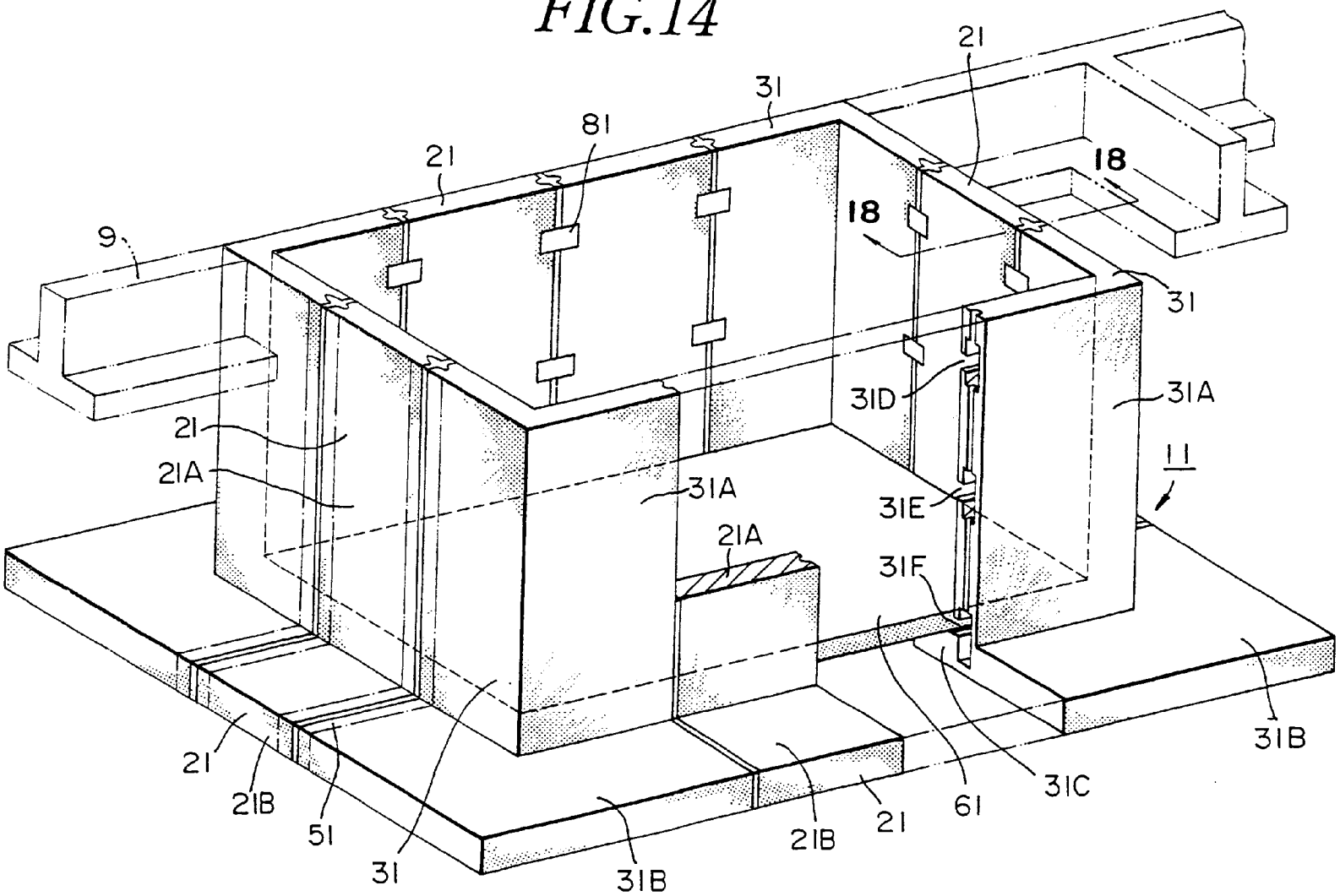
FIG. 14 is a partially cutaway perspective view of another embodiment of the precast modular structure according to the present invention.
Figure 16:
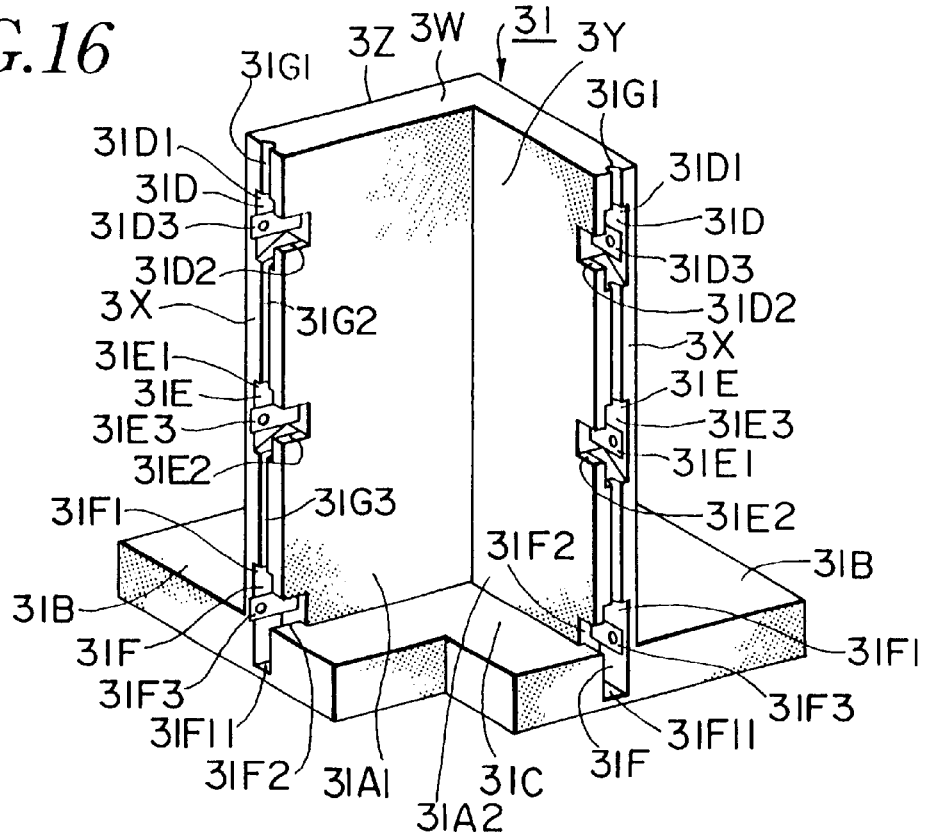
FIG. 16 is a perspective view of another embodiment of the precast modular unit according to the present invention.
Figure 17:
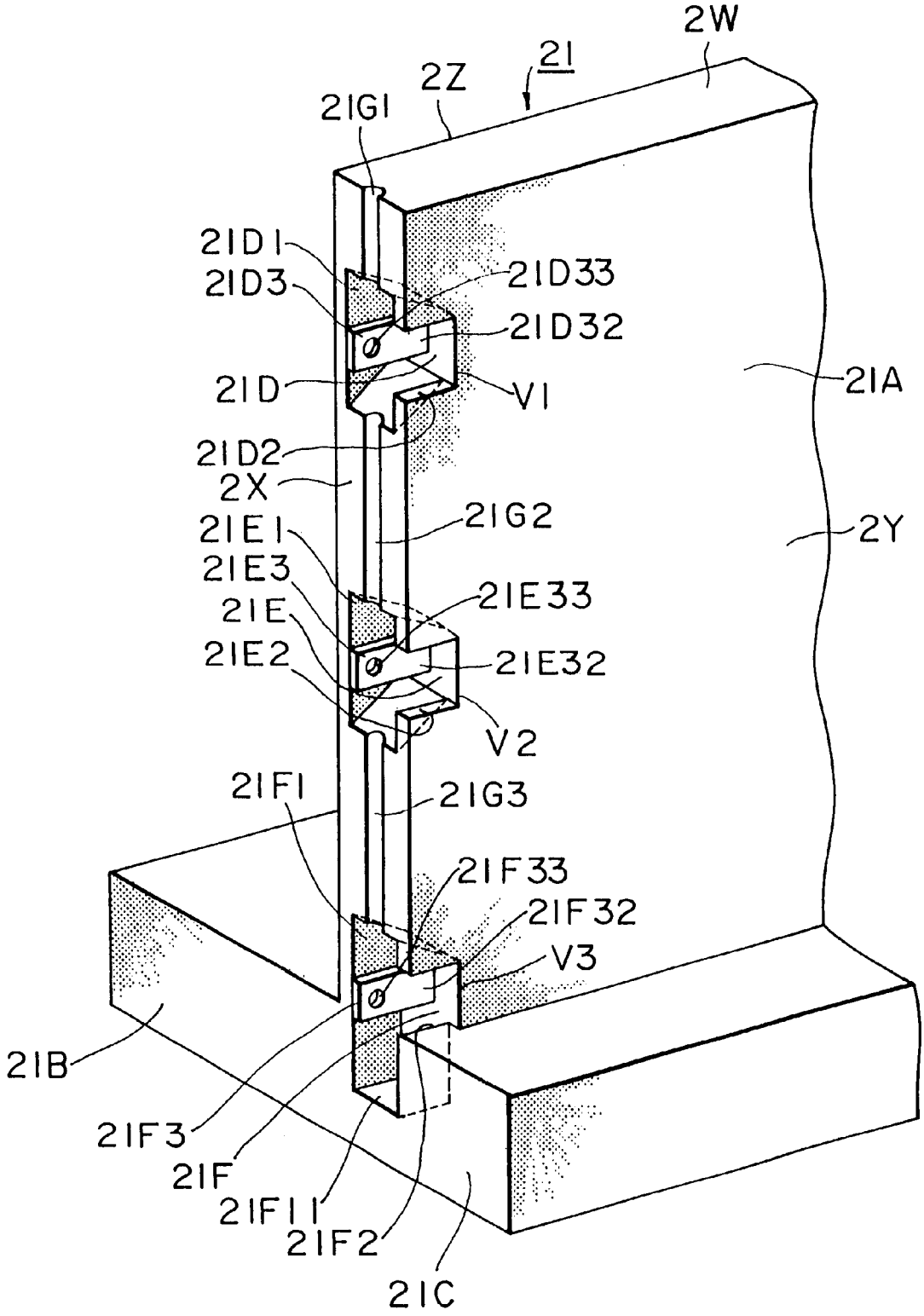
FIG. 17 is an enlarged perspective view of upper, middle and lower connecting portions of the precast modular unit shown in FIG. 15.

FIG. 14 shows a precast modular structure 11, in the form of a basement, according to another embodiment of the present invention. FIGS. 15–17 show other embodiments of a precast wall section 21 and a precast corner section 31 for constructing the basement 11 shown in FIG. 14.

Referring to FIGS. 15 and 16, the wall section 21 and the corner section 31 have the same structure as the wall section 2 and the corner section 3 described above for the embodiments of FIGS. 2 and 3, respectively, except for the structure of the integral footings. More specifically, as shown in FIGS. 15 and 17, the structure of connecting portions 21D, 21E, 21F and corresponding recesses 21D1, 21D2, 21E1, 21E2, 21F1, 21F2, 21F11 and grooves 2lG1, 21G2, 21G3, and the structure of and manner of connecting the connecting plates 21D3, 21E3, 21F3 to the metal mesh reinforcement 13 are the same as described above for the embodiment of the precast wall section 2 shown in FIG. 2. However, the integral footing of the wall section 21 comprises a first base portion 21B extending from the outer surface 2Z and a second base portion 21C extending from the inner surface 2Y. Likewise, as shown in FIG. 16, the structure of connecting portions 31D, 31E, 31F and corresponding recesses 31D1, 31D2, 31E1, 31E2, 31F1, 31F2, 31F11 and grooves 31G1, 31G2, 31G3, and the structure of and manner of connecting the connecting plates 31D3, 31E3, 31F3 to the metal mesh reinforcement 13 are the same as described above for the embodiment of the precast wall section 3 shown in FIG. 3. However, the integral footing of the wall section 31 comprises a first base portion 31B extending from the outer surface 3Z and a second base portion 31C extending from the inner surface 3Y.

Figure 18:
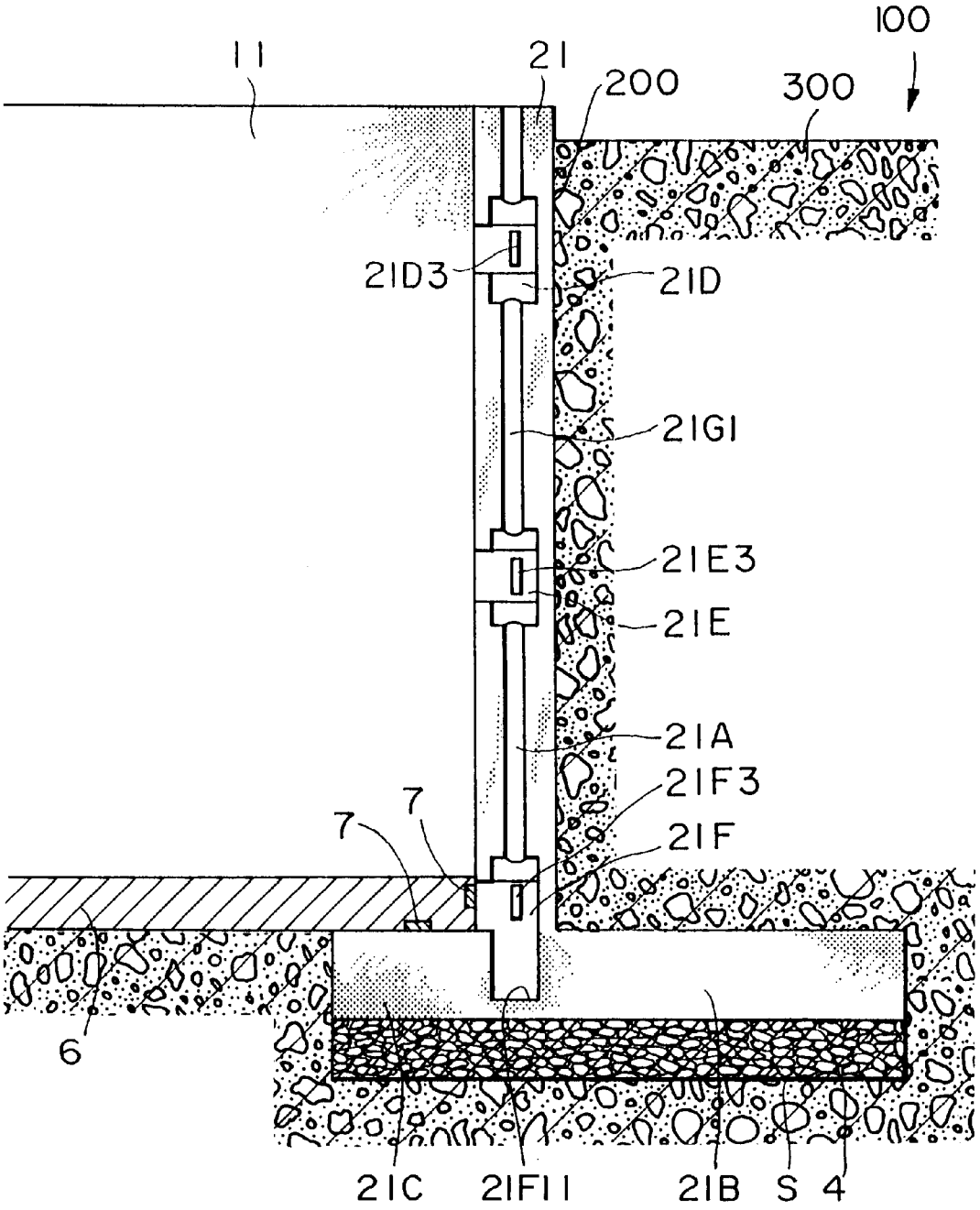
FIG. 18 is an enlarged cross-sectional view taken along line 18—18 of FIG. 14.
Figure 19:
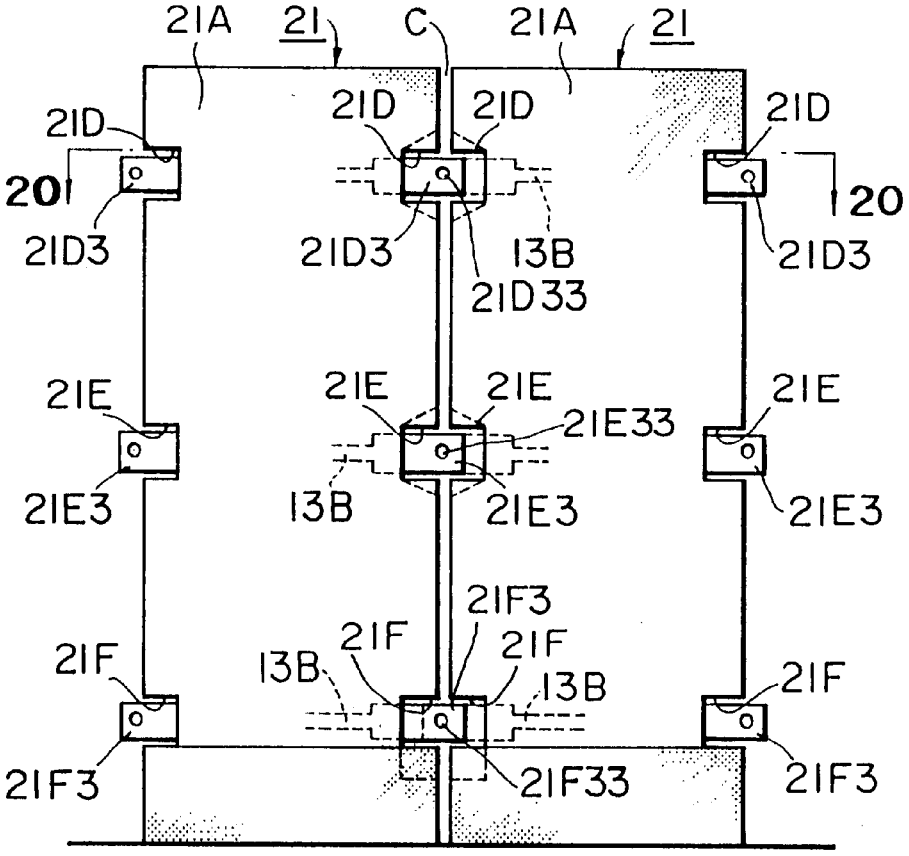
FIG. 19 is a front view illustrating the state of connection of two of the precast modular units shown in FIG. 15.
Figure 20:
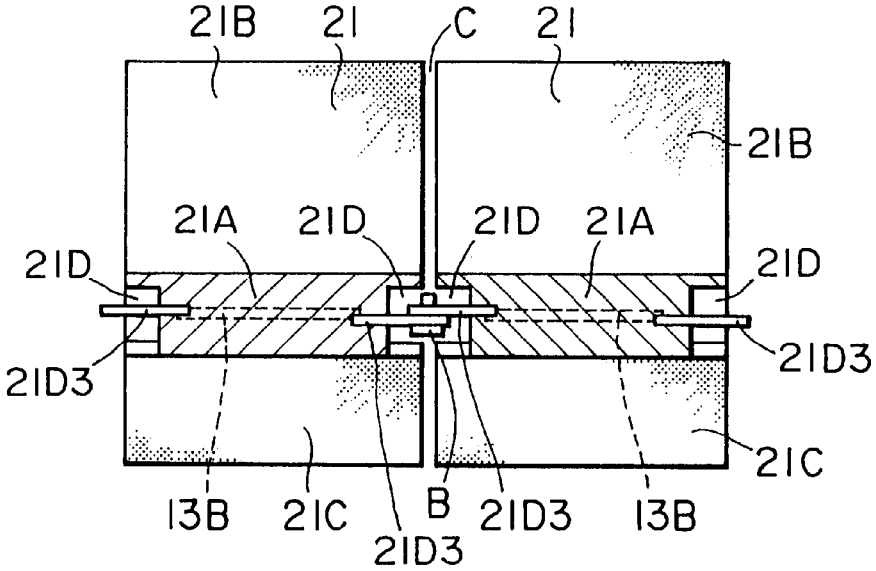
FIG. 20 is an enlarged cross-sectional view taken along line 20—20 of FIG. 19.

The method of connecting adjacent precast wall sections 21 (FIGS. 19–20) and precast corner sections 31, and the method of constructing the basement shown in FIG. 14 using the precast wall sections 21 and corner sections 31 are substantially the same as described above for the embodiments of FIGS. 1 and 8. However, as shown in FIG. 18, in the construction method using the precast wall and corner sections 21, 31, an alkali-reactive waterproof film 7 is attached to upper surface portions of the base portions 21C, 31C of the wall sections 21 and corner sections 31, respectively, in addition to the alkali-reactive waterproof film 7 being attached to the inner lower edges of the wall portions of the wall sections 21 and corner sections 31. Furthermore, as shown in FIGS. 14 and 18, the floor structure 6, which is formed in the area surrounded by the wall and corners sections 21, 31 by pouring concrete or other suitable method, is supported throughout its periphery by the base portions 21C, 31C of the wall sections 21 and corner sections 31. A proper foundation 9 is constructed around upper exterior surface portions of the wall sections 21 and corner sections 31 to provide a support base for the construction of a building structure, such as a dwelling, on the basement 11.

By the foregoing method, the precast wall sections 21 and precast corner sections 31 having integral footings with base portions 21B, 21C and 31B, 31C, respectively, are integrally connected to one another and are firmly supported on the ground by the pressure of the soil, aggregate or other appropriate material 300 surrounding the outer surfaces 2Z, 3Z and the footings of the wall and corner sections. Accordingly, concrete beams and/or reinforcing floor structures are not required in the interior area surrounded by the wall sections 21 and corner sections 31. Thus the basement 11 according to this embodiment of the present invention can be constructed using precast wall sections and corner sections and can enclose large interior spaces for storage or living.

Figure 21:
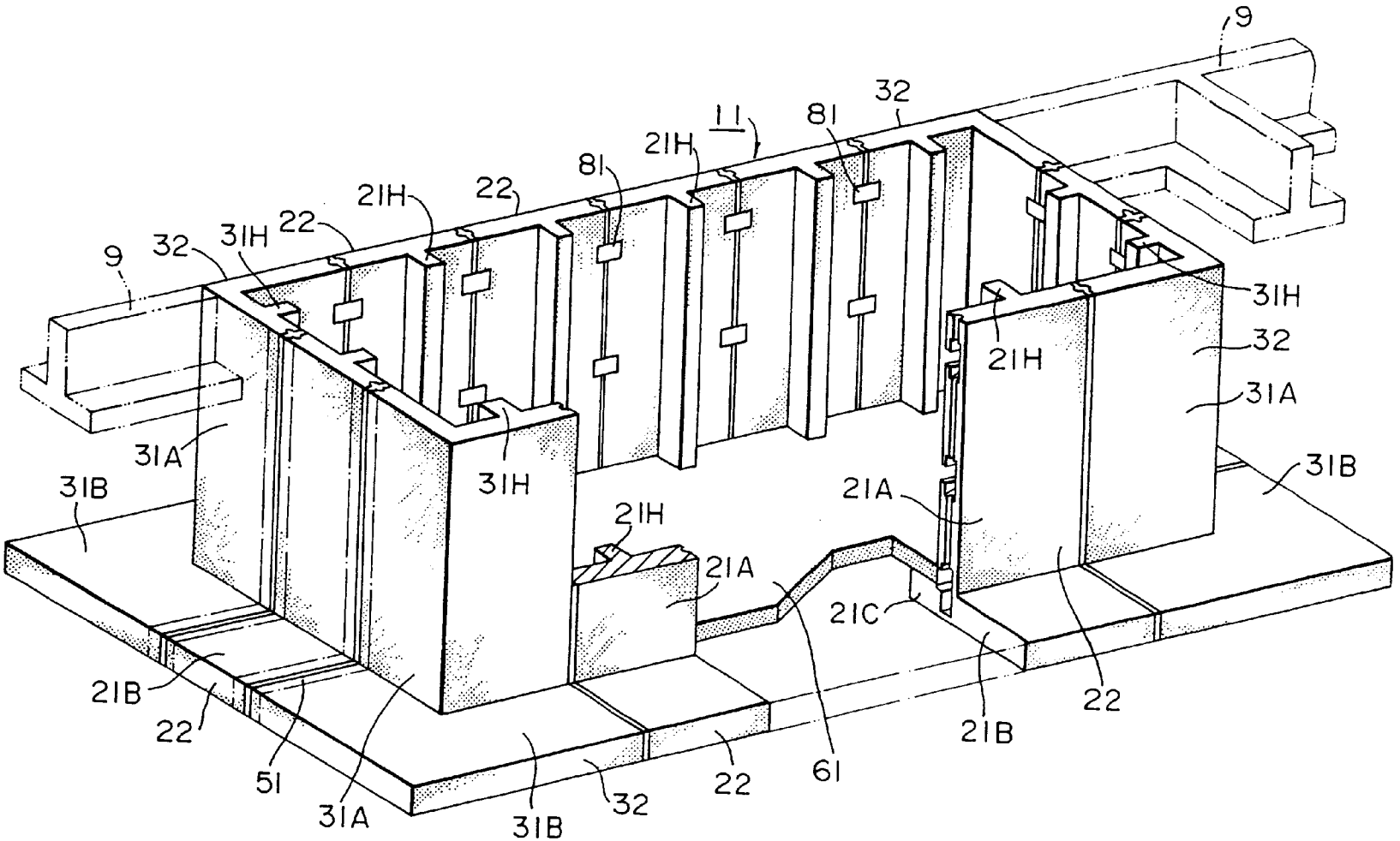
FIG. 21 is a partially cutaway perspective view of another embodiment of the precast modular structure according to the present invention.
Figure 22:
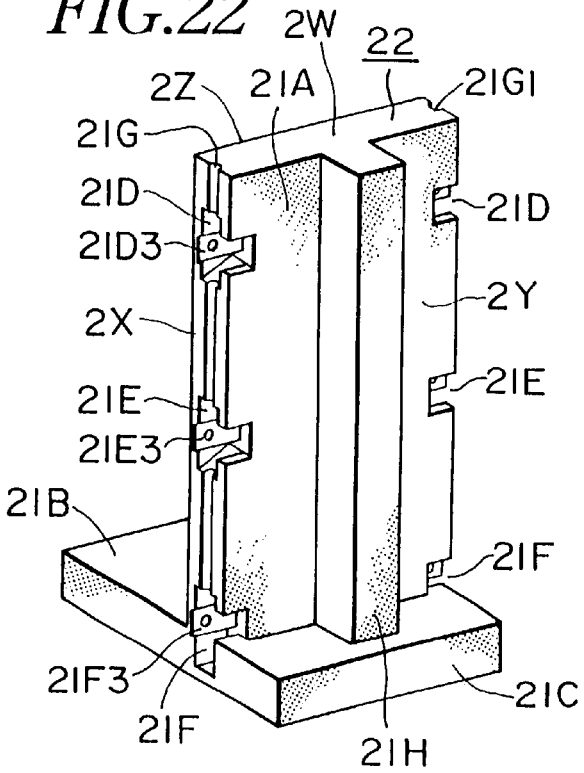
FIG. 22 is a perspective view of another embodiment of the precast modular unit according to the present invention.
Figure 23:
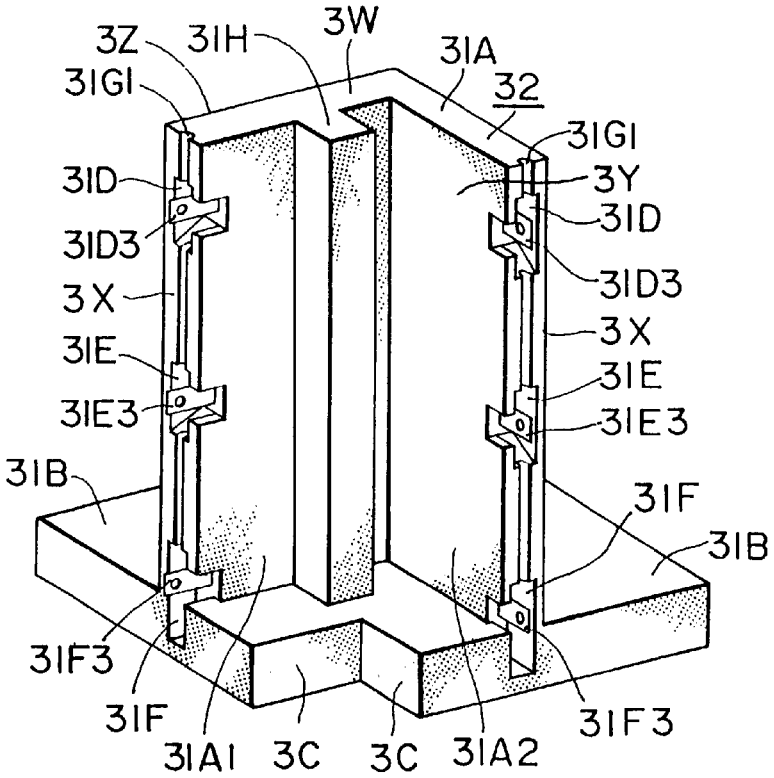
FIG. 23 is a perspective view of another embodiment of the precast modular unit according to the present invention.

FIG. 21 shows a precast modular structure, in the form of a basement, according to another embodiment of the present invention. FIGS. 22–23 show other embodiments of a precast wall section 22 and a precast corner section 32 for constructing the basement shown in FIG. 21. The wall sections 22 and corner sections 32 comprise substantially all of the elements described above for the embodiments of the wall sections 21 and corner sections 31 shown in FIGS. 15 and 16, respectively. However, the wall section 22 further comprises an integral vertical flange portion 21H extending from the inner surface 2Y for strengthening the wall section 22. The corner section 32 further comprises an integral vertical flange portion 31H extending vertically from the inner surface 3Y of the wall portion 31A1 for strengthening the corner section 32. The flange portions 21H, 31H provide sufficient structural strength to the wall sections 22 and corner sections 32, respectively, when the soil, aggregate or other appropriate material 300 applies a large pressure to the outer surfaces 2Z, 3Z of the wall and corner sections.

The method of integrally connecting adjacent wall sections 22 and/or corner sections 32 and the method of constructing the basement shown in FIG. 21 using the wall sections 22 and corner sections 32 are the same as described above for the embodiment shown in FIGS. 14–20. Therefore, a detailed description thereof need not be set forth.

Figure 26:
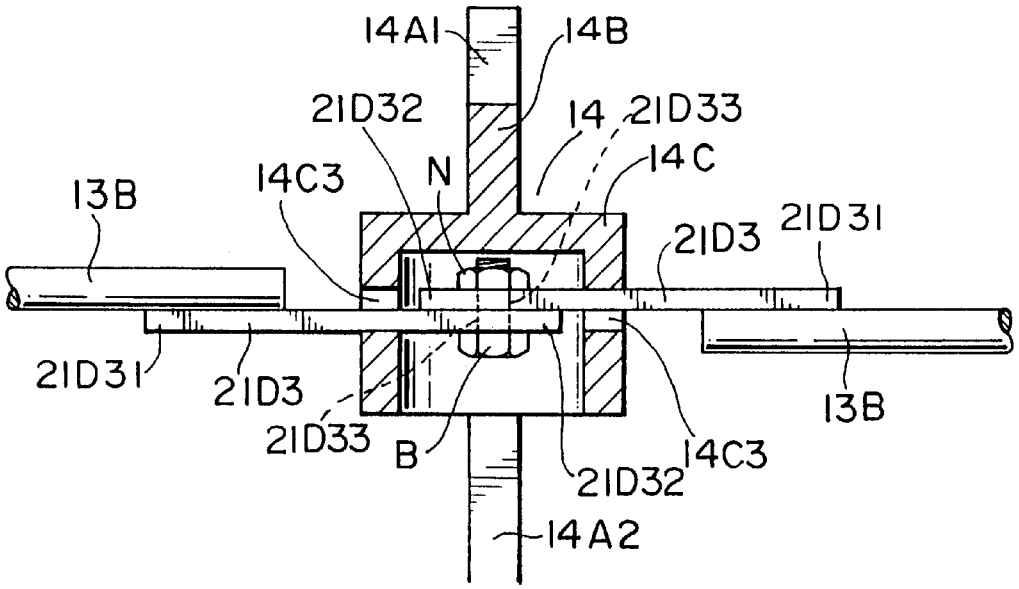
FIG. 26 is an enlarged cross-sectional view taken along line 26—26 of FIG. 25.
Figure 24:
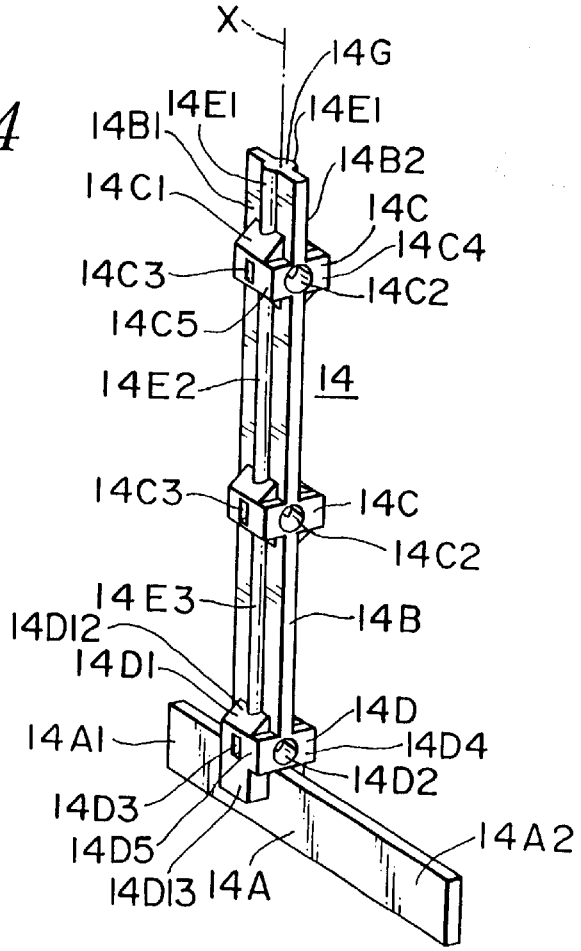
FIG. 24 is a perspective view of another embodiment of the molding plate for forming the precast modular units of the present invention.
Figure 25:
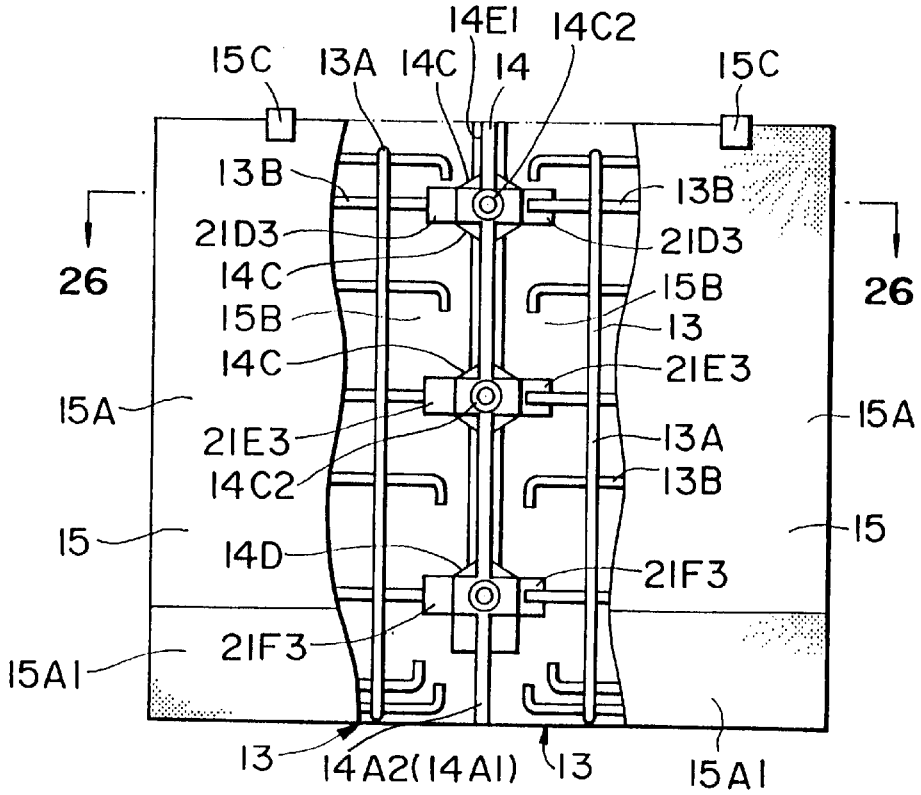
FIG. 25 is a partially cutaway rear view illustrating a method of using modular forms and the molding plate of FIG. 24 to form the precast modular units of the present invention.

FIGS. 24–26 show a method and apparatus for forming two of the precast concrete wall sections 21 according to the present invention. The method and apparatus are substantially as described above for the embodiment of FIGS. 11–13 except for the structure of the base plate of the molding plate which is generally designated at 14 in FIG. 24, and the structure of the hollow stepped portions of the molds which are generally designated at 15, 15 in FIG. 25. Preferably, the molds 15 and the molding plate 14 are made of the same materials as described above for the molds 12 and the molding plate 10 shown in FIGS. 11–12.

As shown in FIG. 25, the molds 15, 15 are configured to be arranged and interconnected to one another in spaced-apart relation for forming the two wall sections 21. Each mold 15 comprises an outer frame 15A, an inner frame 15B disposed in opposite, spaced-apart relation to the outer frame 15A, spacing members 15C for maintaining the inner and outer frames in spaced-apart relation, and a hollow stepped portion 15A1 disposed at a lower end portion of the mold 15. The spaced-apart inner and outer frames 15A, 15B of the mold 15 are configured for forming the wall portion 21A of the wall section 21. The stepped portion 15A1 of the mold 15 is configured for forming the footing 21B of the wall section 21. The space between the inner and outer frames 15A, 15B and the hollow stepped portion 15A1 encase the metal mesh reinforcement 13. For each of the molds 15, the connecting plates 21D3, 21E3, 21F3 are integrally connected to one of the reinforcement members 13B, such as by welding, so that the second end portion 21D32, 21E32, 21F32 of the connecting plates having the connecting holes 21D33, 21E33, 21F33, respectively, protrude from the side edges of the mold.

As shown in FIG. 24, the molding plate 14 comprises a base plate 14A having a first plate portion 14A1 and a second plate portion 14A2 for forming side surfaces of the base portions 21B, 21C, respectively, of the wall section 21, and a vertical plate 14B extending upwardly from the base plate 14A for forming the connecting surfaces 2X of the wall portions 21A. The vertical plate 14B has side surfaces 14B1, 14B2, a central axis X, upper, middle and lower blocks 14C, 14C and 14D, respectively, and upper, middle and lower projections 14E1, 14E2 and 14E3, respectively.

Each of the blocks 10C of the molding plate 14 is comprised of a horizontal hexagonal columnar block body 14C1 having a front surface 14C4 and side surfaces 14C5. Each of the block bodies 14C1 extends from the side surfaces 14B1, 14B2 symmetrically about the central axis X of the vertical plate 14B. Each symmetrical portion of the block bodies 14C1 is generally V-shaped for forming the generally V-shaped cavities V1, V2 on the left and right connecting surfaces 2X of the wall sections 21. A first hole 14C2 extends through the front surface 14C4 of each of the block bodies 14C1 in a direction generally perpendicular to the central axis X. A second hole 14C3 extends through each of the side surfaces 14C5 of the block body 14C1 in a direction generally perpendicular to the first hole 14C2 and the central axis X.

The block 14D of the molding plate 14 comprises a block body 14D1 having an upper portion 14D12 and a lower portion 14D13 extending from the side surfaces 14B1, 14B2 symmetrically about the central axis X of the vertical plate 14B. The upper portion 14D12 has a front surface 14D4, side surfaces 14D5, and a horizontal half-hexagonal columnar shape for forming the recesses 2lF1, 21F2 of the cavity V3 on the left and right connecting surfaces 2X of the wall sections 21. The lower portion 14D12 has a prismatic columnar shape and overlaps an end surface portion of the base plate 14A for forming the recesses 2lF11 of the cavity V3 on the left and right connecting surfaces 2X of the wall sections 21. A first hole 14D2 extends through the front surface 14D4 of the block body 14D in a direction generally perpendicular to the central axis X. A second hole 14D3 extends through each of the side surfaces 14D5 of the block body 14D1 in a direction generally perpendicular to the first hole 14D2 and the central axis X.

Each pair of upper, middle and lower projections 14E1, 14E2, 14E3, respectively, extends from the side surfaces 14B1, 14B2 symmetrically about the central axis X of the vertical plate 14B. The upper projections 14E1 are disposed between the block 14C and an upper end 14G of the vertical plate 14B. The middle projections 14E2 are disposed between the upper block 14C and the middle block 14C. The lower projections 14E3 are disposed between the middle block 14C and the lower block 14D. Each of the projections 14E1, 14E2, 14E3 is generally C-shaped in cross-section for forming the generally C-shaped grooves 21G1, 21G2, 21G3, respectively, on the left and right connecting surfaces 21X of the wall sections 21.

To construct the wall sections 21, the molds 15, 15 are positioned side by side so that side edges of the molds are in confronting, spaced-apart relation to each other, as shown in FIG. 25. In this position, the connecting plates 21D3, 21E3, 21F3 of one of the molds 15 are also in confronting, spaced-apart relation with the corresponding connecting plates 21D3, 21E3, 21F3 of the other mold 15. The molding plate 14 is then interposed between the opposing side edges of the molds 15, 15 so that each of the side surfaces 14B1, 14B2 of the vertical plate 14B confronts the respective side edge of the molds, and the base plate 14A is disposed between the stepped portions 15A1 of the molds. Thereafter, the confronting connecting plates 21D3, 21E3, 21F3 are temporarily connected to one another, while the molding plate 14 is interposed between the side edges of the molding plates as described above, in order to integrate the molds 15, 15 prior to pouring concrete in the molds to form the wall sections 21.

FIG. 26 is a cross-sectional view taken along line 26–26 in FIG. 25 showing how the confronting connecting plates 21D3 are temporarily connected to one another while the molding plate 14 is interposed between the side edges of the molds 15, 15. The end portions 21D32 of the confronting connecting plates 21D3 are respectively passed through the second holes 14C3 of the upper block 14C of the molding plate 14 so that the connecting holes 21D33 are positioned inside the first hole 14C2 of the upper block 14C. In this position, the connecting plates 21D3 are in overlapping relation so that the connecting holes 21D33 formed on the end portions 21D32 are aligned with one another. The connecting plates 21D3 are then temporarily connected to one another using suitable connecting elements, such as a threaded bolt B and a nut N.

Each pair of confronting connecting plates 21D3 and 21F3 are respectively connected to one another in the same manner as described above for the connecting plates 21D3. More specifically, the end portions 21E32 of the confronting connecting plates 21E3 are respectively passed through the second holes 14C3 of the middle block 14C of the molding plate 14 so that the connecting holes 21E33 are positioned inside the first hole 14C2 of the middle block 14C. In this position, the connecting plates 21E3 are in overlapping relation so that the connecting holes 21E33 formed on the end portions 21E32 are aligned with one another. Likewise, the end portions 21F32 of the confronting connecting plates 21F3 are respectively passed through the second holes 14D3 of the lower block 14D of the molding plate 14 so that the connecting holes 21F33 are positioned inside the first hole 14D2 of the lower block 14D. In this position, the connecting plates 21F3 are in overlapping relation so that the connecting holes 21F33 formed on the end portions 21F32 are aligned with one another. The respective connecting plates 2lE3 and 21F3 are then temporarily connected to one another using suitable nut and bolt connecting elements as described above for connecting plates 21D3.

By the foregoing construction and connecting method, the molds 15, 15 are integrally connected to one another with the molding plate 14 interposed therebetween. After the molds 15, 15 and the molding plate 14 are assembled as described above, concrete is poured into the molds. After the concrete is allowed to cure, the molds 15, 15 and the molding plate 14 are removed to obtain two of the precast wall sections 21 shown in FIG. 15.

The foregoing description sets forth a method according to the present invention for forming two of the wall sections 21. It is understood by those of ordinary skill in the art, however, that more than two wall sections 21 can be formed in a single forming operation. For example, three or more of the molds 15 can be arranged side by side in a horizontal row, and adjacent molds 15 are integrally connected to one another with one of the molding plates 14 interposed therebetween in the manner described above. After the concrete is poured into each of the molds 15 and allowed to cure, the molds and the connecting plates 14 are removed to obtain the precast wall sections 21.

The structure of the molds and the method of forming the precast wall sections 22 and the corner sections 31, 32 are substantially the same as described above for the precast wall sections 21. The only difference is in the structure of the molds used to form the wall sections 22, which have the flange portion 21H, and the corner sections 31, 32, which have the angled wall portions 31A1, 31A2 (corner sections 31, 32) and the flange portion 31H (corner section 32). The structure of the molding plate for forming the connecting portions 21D, 21E, 21F of the wall sections 22 and the connecting portions 31D, 31E, 31F of the corner sections 31, 32 is identical to the structure of the molding plate 14 described above for the formation of the connecting portions 21D, 21E, 21F of the precast wall sections 21.

The precast wall sections and corner sections according to the foregoing embodiments of the present invention have a height that is sufficient to provide for a floor covering, a ceiling, space for utilities and the desired floor to ceiling space. The length of the precast wall and corner sections can vary, as required, as long as they can be transported to a construction site at a reasonable cost. Furthermore, the precast corner sections described above have right angle wall portions with two connecting surfaces that connect to adjacent precast wall sections, or to another precast corner section. Alternatively, the corner sections could have wall portions that extend at an angle other than 90 degrees relative to each other.

In the embodiments shown in FIGS. 1, 8, 14 and 21, the precast wall and corner sections according to the present invention have been erected to form generally rectangular, precast boxed-shaped modular structures. It is understood by those of ordinary skill in the art, however, that the precast wall and corner sections can be constructed with different number of connecting surfaces and a variety of shapes to construct precast modular structures of various geometrical shapes.

The following advantages are obtained by the precast modular units, methods an apparatuses for forming the precast modular units, the precast modular structures, and the methods for constructing the precast modular structures according to the present invention.

A. The structure of the precast modular units and the method of connecting the precast modular units to construct the precast modular structures according to the present invention will prevent vertical movement between and both lateral and longitudinal horizontal separation of the precast modular units. Most loads on each of the precast modular units will result in tension loads on the entire embedded metal mesh reinforcement. There will also be bending, torsion and shear loads exerted on the metal mesh reinforcement. Compression loads are, for the most part, resisted by the concrete in which the metal mesh reinforcement is embedded. The bending, torsion and shear loads, like the tension loads, are transmitted throughout the entire precast modular structure by the metal mesh reinforcement and by the connecting plates. The end result is a precast modular structure with superior strength to withstand the forces of nature.

B. The precast modular structures, such as the basements shown in FIGS. 1, 8, 14 and 21, can be completed within a remarkably short period of time (e.g., about 3 days) as compared to the conventional art, thereby reducing construction costs.

C. The precast modular structures can be prepared in a factory with strict quality control to obtain uniform and high quality precast modular structures.

D. An adequate resistance to adsorption of water is obtained by applying a sealant or waterproof material only on the outer surface of each rigid joint formed between each pair of adjacently connected precast modular unit.

E. The surfaces of ceilings and walls of the precast modular structures can be covered with fire-proof boards. A fire-resistant ceiling structure can also be obtained using ALC plates (light weight concrete boards), commercially available concrete boards, and the like.

F. When the precast modular structure is a garage, the depth of excavation at the building site is less than for a basement. Accordingly, no retaining walls are required for the garage, and the entrance part of the garage is preferably constructed using a precast concrete foundation having a short depth. The surfaces of ceilings and walls of the garage can also be covered with fire-proof boards or other fire-resistant ceiling structure as set forth above in paragraph E for the basement.

G. A wooden or steel framework building may be disposed on the precast modular structure for use as a dwelling and the like.

H. With conventional commercially available prefabricated structures, such as basements or garages, the wall surfaces, ceiling surfaces and floor are integrally formed. Such structures are difficult to construct because of the difficulty in transporting the basement or garage to the installation site due to the large weight thereof. Accordingly, it has been necessary to reduce the size of such prefabricated structures in order to reduce their overall weight for transportation purposes. As a result, such prefabricated structures enclose relatively small interior spaces and therefore fail to provide sufficient space for storage or living.

In contrast, according to the present invention, the precast modular units can be easily transported to the construction site and erected to form the precast modular structure, such as a basement or a garage, and the ceiling or roof and the floor structure for the precast modular structure can then be constructed on site. Furthermore, the precast modular units having vertical wall portions and integral footings are integrally connected to one another and are firmly supported on the ground by the pressure of the soil, aggregate or other appropriate material surrounding the outer surfaces of the wall portions and the footings. Accordingly, concrete beams and/or reinforcing floor structures are not required in the interior area of the precast modular structure defined by the precast modular units. Thus the precast modular structures according to the present invention can be constructed using precast modular units which can enclose large interior spaces for storage or living. For example, the construction of modern music halls, libraries, storage facilities, workshops and the like require large interior spaces and soundproof and fire-resistant properties, and are required to maintain a constant temperature. Such requirements can be satisfied by the interior space of the precast modular structure according to the present invention.

I. When the precast modular structure is used as a room of a first floor of a dwelling for habitational purposes or as a storage facility, the precast modular structures are provided with openings for windows and entrances. A wooden or steel framework structure can be installed on the room to construct additional floors.

J. Precast modular structures other than basements, garages, storage facilities and dwellings, such as stilted foundations and fire cisterns (snow-melting tanks), can also be constructed using the precast modular units according to the present invention. When the precast modular structure is a stilted foundation, the precast modular units have a sufficient height for this purpose. The precast modular structure can be constructed to provide a snow-melting tank which can be installed at a preselected site in a location having high snow accumulations and used for snow disposal.

From the foregoing description, it can be seen that the present invention provides improved precast modular units, methods and apparatuses for forming the precast modular units, precast modular structures, and methods for constructing the precast modular structures. It will be appreciated by those skilled in the art that obvious changes can be made to the embodiments described in the foregoing description without departing from the broad inventive concept thereof. It is understood, therefore, that this invention is not limited to the particular embodiments disclosed, but is intended to cover all obvious modifications thereof which are within the scope and the spirit of the invention as defined by the appended claims.

What is claimed is:

1. An apparatus for forming precast modular units, the apparatus comprising: at least two modular forms configured to be selectively arranged and interconnected in spaced-apart relation to one another; a plurality of reinforcement members disposed in each of the modular forms; a plurality of connecting members each having a first end integrally connected to one of the reinforcement members and a second end extending from opposite side edges of each of the modular forms; a plurality of connectors for releasably connecting the second end of each of the connecting members of one of the modular forms to a corresponding connecting member of another one of the modular forms to integrally connect the modular forms to one another; and a molding plate configured to be arranged between the side edges of modular forms when the modular forms are connected to one another.

2. An apparatus according to claim 1; wherein each of the modular forms comprises a pair of opposite, spaced-apart frames and a hollow stepped portion extending from the frames, the reinforcement members being disposed between the frames and in the hollow stepped portion, and wherein the frames, the hollow stepped portion and the reinforcement members of each of the modular forms define spaces within the modular form configured to receive and allow flow of a construction material being poured therein to form a precast modular unit.

3. An apparatus according to claim 2; wherein the spaces within the modular form are configured to receive and allow the flow of concrete being poured therein to form a precast modular unit.

4. An apparatus according to claim 2; wherein the molding plate comprises a base plate and a vertical plate extending from the base plate, the vertical plate and the base plate being configured to be arranged between side edges of the frames and the hollow stepped portions, respectively, when the modular forms are connected to one another.

5. A method of forming precast modular units, comprising the steps of: providing at least two modular forms each having a plurality of reinforcement members disposed in each of the modular forms, and a plurality of connecting members each having a first end integrally connected to one of the reinforcement members and a second end extending from opposite side edges of each of the modular forms; positioning the modular forms side by side so that one of the side edges of one of the modular forms is disposed in confronting, spaced-apart relation to a corresponding side edge of another modular form; disposing a molding plate between the confronting side edges of the modular forms; releasably connecting the second end of each of the connecting members extending from the side edge of one of the modular forms to a corresponding connecting member of the other modular form to removably connect together the modular forms and the molding plate; pouring a construction material into the connected modular forms; allowing the construction material to cure; and removing the modular forms and the molding plate to form precast modular units.

6. A method for constructing a precast modular structure, comprising the steps of: providing a plurality of generally different precast modular unit sets each having a plurality of identical precast modular units, each of the precast modular units of each precast modular unit set having connecting surfaces; transporting the precast modular units of each precast modular unit set to a construction site; positioning each of the precast modular units on a ground surface at the construction site so that each of the connecting surfaces of each of the precast modular units is in confronting, spaced-apart relation to a corresponding connecting surface of an adjacent identical precast modular unit or a precast modular unit of another precast modular unit set; connecting the confronting connecting surfaces of each pair of adjacent precast modular units to form a channel therebetween; pouring a construction material into each of the channels formed between each pair of adjacent precast modular units; allowing the construction material to cure to form a rigid joint between each pair of adjacent precast modular units to integrally connect the precast modular units to form a wall structure having a predetermined shape, an interior space, and interior and exterior wall surfaces having the rigid joints; burying the wall structure; and forming a floor structure in the interior space of the wall structure.

7. A method according to claim 6; wherein the construction material comprises concrete.

8. A method according to claim 6; including the step of applying a waterproof material on each rigid joint from the exterior wall surface of the wall structure before the burying step.

9. A method according to claim 6; further comprising the step of attaching an alkali-reactive waterproof film to inner lower edges of the connected precast concrete modular units prior to forming the floor structure.

10. A method according to claim 6; wherein the positioning step includes positioning each of the precast modular units on compacted unscreened gravel or sand.

11. A method according to claim 6; wherein each precast modular unit of each precast modular unit set comprises precast concrete with metal mesh reinforcement.

* * * * *